US006531272B1

(12) United States Patent
Friday et al.

(10) Patent No.: US 6,531,272 B1
(45) **Date of Patent: *Mar. 11, 2003**

(54) COLOR PHOTOGRAPHIC ELEMENT CONTAINING A FRAGMENTABLE ELECTRON DONOR FOR IMPROVED PHOTOGRAPHIC RESPONSE

(75) Inventors: James A. Friday, Rochester, NY (US); Joseph P. Pepe, Penfield, NY (US); Jeffrey C. Hansen, Fairport, NY (US); Annabel A. Muenter, Rochester, NY (US); Jerome R. Lenhard, Fairport, NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/236,708

(22) Filed: Jan. 25, 1999

(51) Int. Cl.[7] ..... G03C 1/08; G03C 1/10; G03C 1/12

(52) U.S. Cl. ..... 430/505; 430/567; 430/569; 430/581; 430/583; 430/584; 430/585; 430/586; 430/587; 430/588; 430/590; 430/591; 430/592; 430/600

(58) Field of Search ..... 430/567, 569, 430/600, 581, 505, 583, 584, 585, 586, 587, 590, 591, 592, 588

(56) References Cited

U.S. PATENT DOCUMENTS

| | | | | | |
|---|---|---|---|---|---|
| 5,460,928 | A | | 10/1995 | Kam-Ng et al. | 430/503 |
| 5,576,157 | A | | 11/1996 | Eikenberry et al. | 430/503 |
| 5,663,041 | A | * | 9/1997 | Chang et al. | 430/569 |
| 5,744,297 | A | * | 4/1998 | Chang et al. | 430/567 |
| 5,747,235 | A | * | 5/1998 | Farid et al. | 430/583 |
| 5,747,236 | A | * | 5/1998 | Farid et al. | 430/583 |
| 5,900,356 | A | * | 5/1999 | Sato | 430/506 |
| 5,994,051 | A | * | 11/1999 | Gould et al. | 430/588 |
| 6,054,260 | A | * | 4/2000 | Adin et al. | 430/583 |
| 6,153,371 | A | * | 11/2000 | Farid et al. | 430/581 |

FOREIGN PATENT DOCUMENTS

| | | | | |
|---|---|---|---|---|
| EP | 786692 | * | 7/1997 | G03C/1/16 |

OTHER PUBLICATIONS

Kodak.com (product information:One–Time–Use Cameras).*

Fujifilm.com (Consumer product information: One–Time–Use Cameras).*

* cited by examiner

*Primary Examiner*—Janet Baxter
*Assistant Examiner*—Amanda C. Walke
(74) *Attorney, Agent, or Firm*—Edith A. Rice

(57) ABSTRACT

This invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said layers comprises large tabular grains having an average circular diameter of greater than 2 $\mu$m and contains a fragmentable electron donating compound is of the formula: X—Y' or a compound which contains a moiety of the formula —X—Y'; wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and
2) the oxidized form of X—Y' undergoes a bond cleavage reaction to give the radical X. and the leaving fragment Y'; and, optionally,
3) the radical X. has an oxidation potential $\leqq -0.7$V (that is, equal to or more negative than about −0.7V).

34 Claims, No Drawings

COLOR PHOTOGRAPHIC ELEMENT CONTAINING A FRAGMENTABLE ELECTRON DONOR FOR IMPROVED PHOTOGRAPHIC RESPONSE

FIELD OF THE INVENTION

This invention relates to a color photographic element having improved photographic response.

Definitions

A tabular grain emulsion is one in which at least 50 percent of total grain projected area is accounted for by tabular grains.

As employed herein the term "tabular grain" is employed to indicate grains that have two parallel major faces substantially larger than any remaining face and that exhibit an aspect ratio of at least 2.

Aspect ratio is the ratio of tabular grain equivalent circular diameter (ECD) divided by thickness (t). The average aspect ratio of a tabular grain emulsion is the ratio of average grain ECD divided by average grain thickness.

A 3D emulsion is one in which at least 50 percent of total grain projected area is accounted for by 3D grains. As used herein, the term "3D grain" refers to non-tabular morphologies, for example cubes, octahedra, rods and spherical grains, and to tabular grains having an aspect ratio of less than 2.

In referring to grains and emulsions containing two or more halides, the halides are named in order of ascending concentrations.

BACKGROUND OF THE INVENTION

It is a long-standing objective of color photographic origination materials to maximize the overall response to light while maintaining the lowest possible granularity. Increased photographic sensitivity to light (commonly referred to as photographic speed) allows for improved images captured under low light conditions or improved details in the shadowed regions of the image. In general, the overall light sensitivity provided by the light sensitive silver halide emulsions in such systems is determined by the size of the emulsions. Larger emulsions capture more light. In color photographic elements, upon development, the captured light is ultimately converted into dye deposits which constitute the reproduced image. However, the granularity expressed by these dye deposits is directly proportional to the grain size of the silver halide emulsion. Thus, larger silver halide emulsion grains have higher sensitivity to light but also lead to higher granularity in the reproduced image. It has been a long-standing problem to provide materials which maximize the response to light of a silver halide emulsion for any given grain size.

It is of particular interest to find solutions to this problem for large emulsions with the potential for providing high speed (preferably ISO 400 or greater) color photographic materials. Such high speed materials have a number of potential applications. They are particularly valuable for use in cameras with zoom lenses and in single use cameras (also called "film with lens" units). Zoom lenses generally have smaller apertures (higher f-numbers) than comparable fixed focus lenses. Thus, zoom lenses, while giving increased flexibility in composition of a pictorial scene, deliver less light to the camera film plane. Use of high speed films allows the flexibility of zoom lenses while still preserving picture taking opportunities at low light levels. In single use cameras, lens focus is fixed. Here, high speed films allow use of a fixed aperture having a higher f-number, thus increasing the available depth of field, an important feature in a fixed focus camera. For single use cameras with flash, higher film speed allows pictures to be taken with a less energetic flash, enabling more economical manufacture of the single use unit.

The problem of maximizing response of the emulsion grain to light is particularly important for the blue sensitive emulsions of high speed materials, since standard scene illuminants are at least somewhat deficient in blue light. As a result, 3D AgBrI emulsions with light absorption enhanced by high iodide content are generally employed in the fast yellow emulsion layer of the highest speed color photographic films. Unfortunately, these large fast yellow 3D emulsions also compromise the acutance of underlying layers. Tabular grains as fast yellow emulsions offer advantages for acutance of underlying layers but up until now have been deficient for adequate speed/granularity.

SUMMARY OF THE INVENTION

We have discovered that adding a fragmentable electron donor to an emulsion comprising large tabular grains enables these emulsions to achieve speed/granularity adequate for high speed photography.

One aspect of this invention comprises a multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said layers comprises large tabular grains having an equivalent circular diameter (ECD) of greater than 2 $\mu$m and contains a fragmentable electron donating compound is of the formula: X—Y' or a compound which contains a moiety of the formula —X—Y'; wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and
2) the oxidized form of X—Y' undergoes a bond cleavage reaction to give the radical $X^\bullet$ and the leaving fragment Y'; and, optionally,
3) the radical $X^\bullet$ has an oxidation potential $\leqq -0.7$V (that is, equal to or more negative than about −0.7V).

Another aspect of this invention comprises a single use camera comprising a roll of film, a taking lens, a shutter release, a film advance and a viewfinder, wherein the roll of film comprises a transparent support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein at least one of said layers comprises large tabular grains having an average equivalent circular diameter of greater than 2 μm and contains a fragmentable electron donor compound of the formula X—Y' or a compound which contains a moiety of the formula —X—Y'; wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and
2) the oxidized form of X—Y' undergoes a bond cleavage reaction to give the radical $X^\bullet$ and the leaving fragment Y'; and, optionally,
3) the radical $X^\bullet$ has an oxidation potential $\leqq -0.7$V (that is, equal to or more negative than about −0.7V).

DETAILED DESCRIPTION OF THE INVENTION

In accordance with this invention a silver halide emulsion contains a fragmentable electron donating (FED) compound which enhances the sensitivity of the emulsion. The fragmentable electron donating compound is of the formula X—Y' or a compound which contains a moiety of the formula —X—Y'; wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and
2) the oxidized form of X—Y' undergoes a bond cleavage reaction to give the radical $X^\bullet$ and the leaving fragment Y'; and, optionally,
3) the radical $X^\bullet$ has an oxidation potential $\leqq -0.7$V (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions are believed to take place when X—Y undergoes oxidation and fragmentation to produce a radical $X^\bullet$, which in a preferred embodiment undergoes further oxidation.

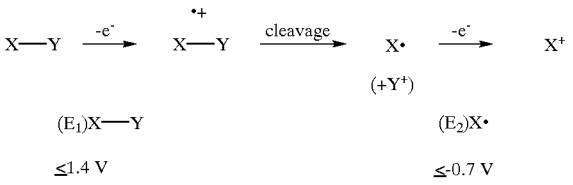

The structural features of X—Y are defined by the characteristics of the two parts, namely the fragment X and the fragment Y. The structural features of the fragment X determine the oxidation potential of the X—Y molecule and that of the radical $X^\bullet$, whereas both the X and Y fragments affect the fragmentation rate of the oxidized molecule $X—Y^{\bullet+}$.

In embodiments of the invention in which Y' is H, the following represents the reactions believed to take place when the compound X-H undergoes oxidation and deprotonation to the base, $\beta^-$, to produce a radical $X^\bullet$, which in a preferred embodiment undergoes further oxidation.

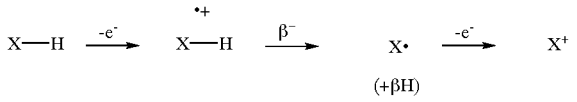

Preferred X groups are of the general formula:

(I)

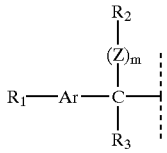

(II)

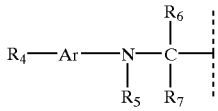

(III)

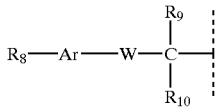

or (IV)

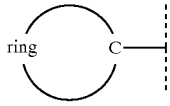

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

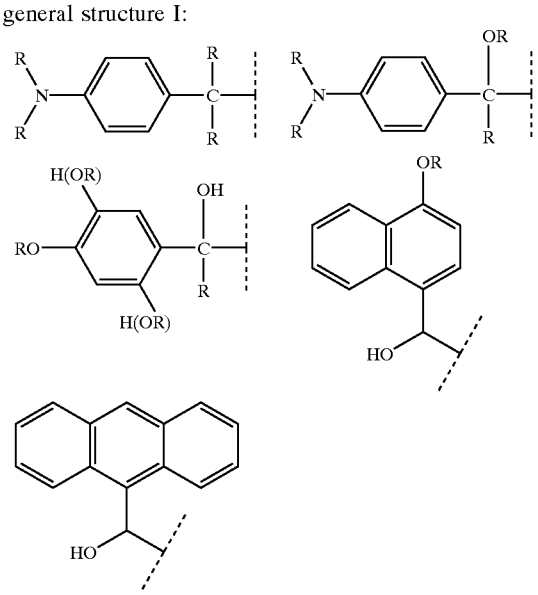

-continued

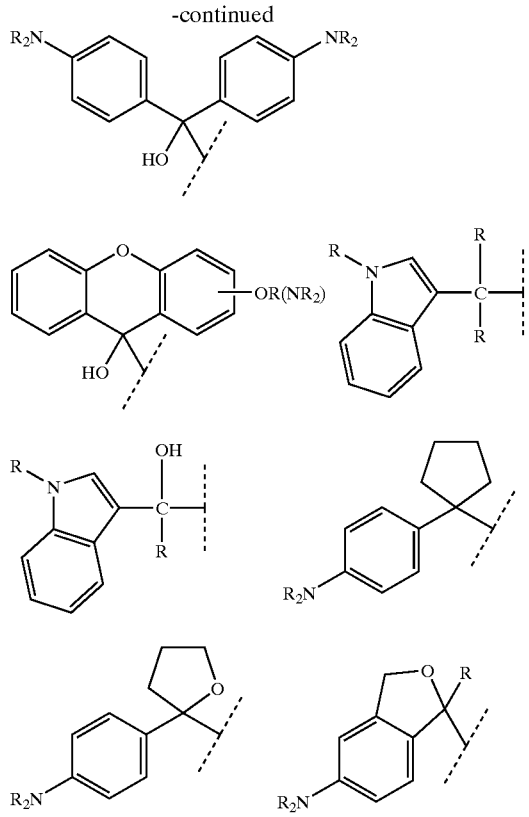

In the structures of this patent application a designation such as —OR($NR_2$) indicates that either —OR or —$NR_2$ can be present.

The following are illustrative examples of the group X of general structure II:

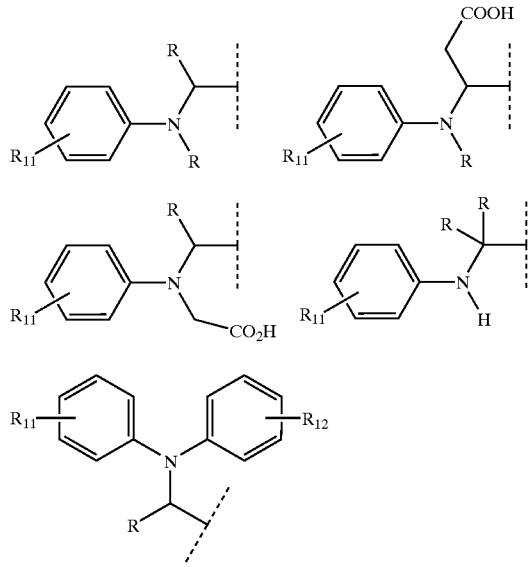

$R_{11}$ and $R_{12}$ = { H, alkyl, alkoxy, alkylthio, halo, carbamoyl; carboxyl, amido, formyl, sulfonyl, sulfonamido, nitrile }

-continued

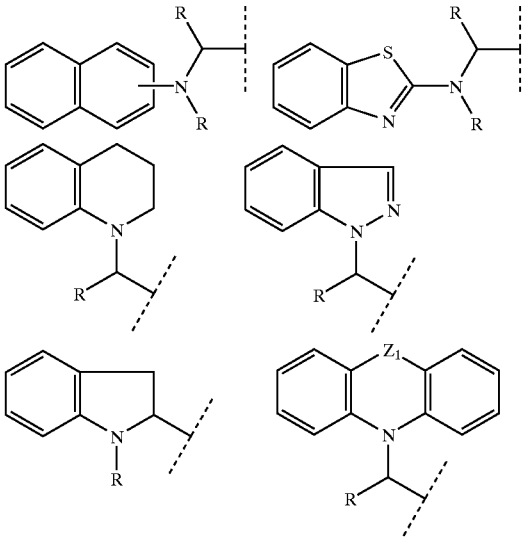

$Z_1$=a covalent bond, S, O, Se, NR, $CR_2$, CR═CR, or $CH_2CH_2$.

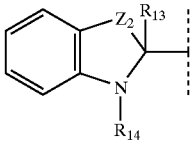

$Z_2$=S, O, Se, NR, $CR_2$, CR═CR, $R_{13}$, =alkyl, substituted alkyl or aryl, and $R_{14}$=H, alkyl substituted alkyl or aryl.

The following are illustrative examples of the group X of the general structure III:

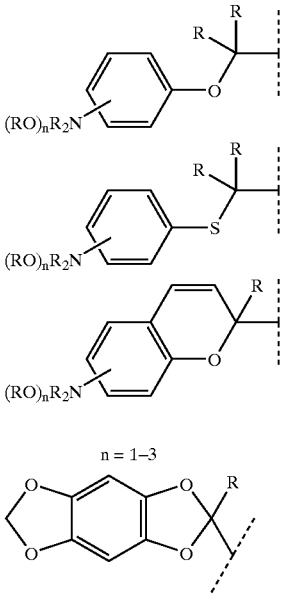

The following are illustrative examples of the group X of the general structure IV:

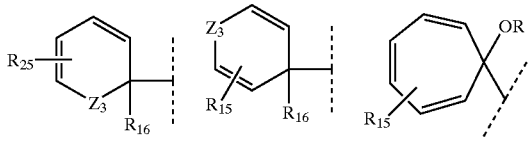

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached (2)

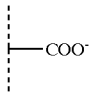

(3)

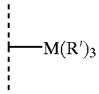

where M=Si, Sn or Ge; and R'=alkyl or substituted alkyl (4)

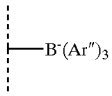

where Ar"=aryl or substituted aryl (5)

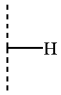

In preferred embodiments of this invention Y' is —H, —$COO^-$ or —$Si(R')_3$ or —X'. Particularly preferred Y' groups are —H, —$COO^-$ or —$Si(R')_3$.

In embodiments of the invention in which Y' is a proton, a base, β, is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |

TABLE I-continued

| pKa's in water of the conjugate acids of some useful bases | |
|---|---|
| $S—CH_2—CO_2^-$ | 3.48 |
| $CH_3—CO—NH—CH_2—CO_2^-$ | 3.67 |
| $CO_2^-$ | 4.19 |
| $N^-$ $CO_2^-$ | 4.96 |
| $CH_3—COS^-$ | 3.33 |
| $H_2N$ $SO_3^-$ | 3.73 |
| Me $SeO_3^-$ | 4.88 |
| O H N $CH^-$ O N O H | 4.01 |
| O Me N $CH^-$ O N O Me | 4.7 |
| $(CH_3)_3\overset{+}{N}—\overset{-}{O}$ | 4.65 |
| $H_2N—CH_2—CH(CH_3)—\overset{+}{N}H_3$ | 6.61 |
| N | 5.25 |
| Me Me N | 6.15 |
| S N | 2.44 |

TABLE I-continued

| pKa's in water of the conjugate acids of some useful bases | |
|---|---|
| N N H | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$$Z—(L—X—Y')_k$$

$$A—(L—X—Y')_k$$

$$(A—L)_k—X—Y'$$

$$Q—X—Y'$$

$$A—(X—Y')_k$$

$$(A)_k—X—Y'$$

$$Z—(X—Y')_k$$

or $$(Z)_k—X—Y'$$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

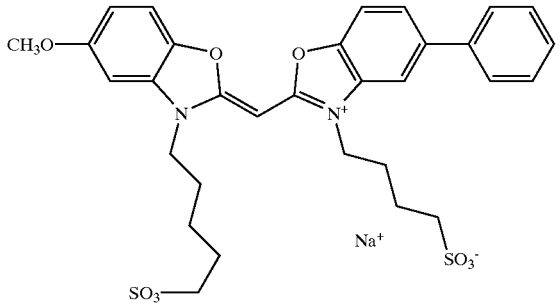

Dye 2

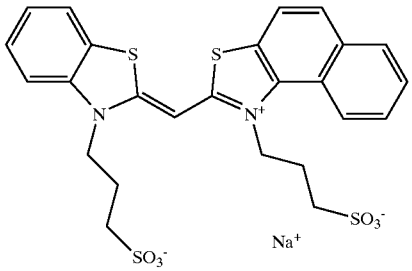

Dye 3

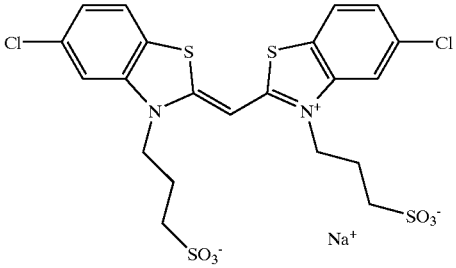

Dye 4

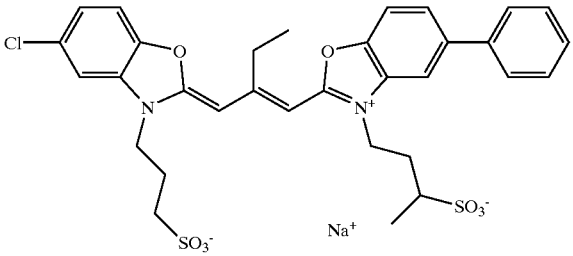

Dye 5

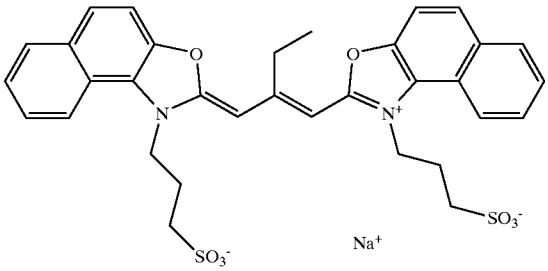

-continued

Dye 6

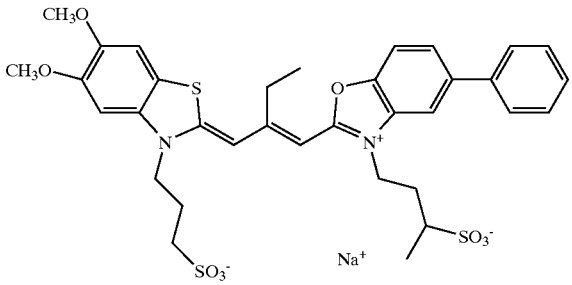

and

Dye 7

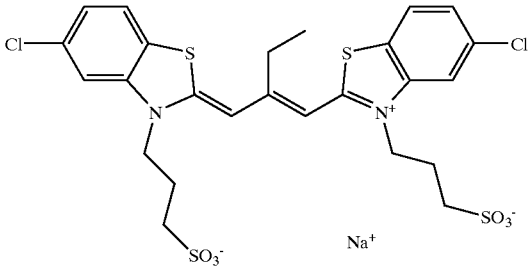

and

Dye 8

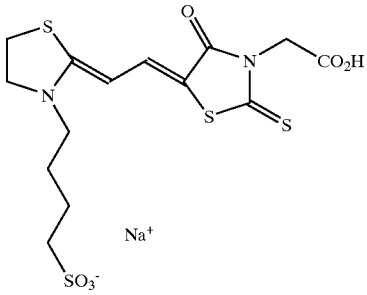

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

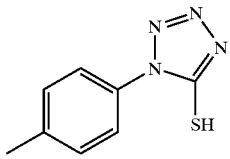

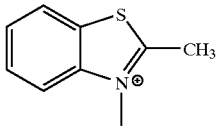

-continued

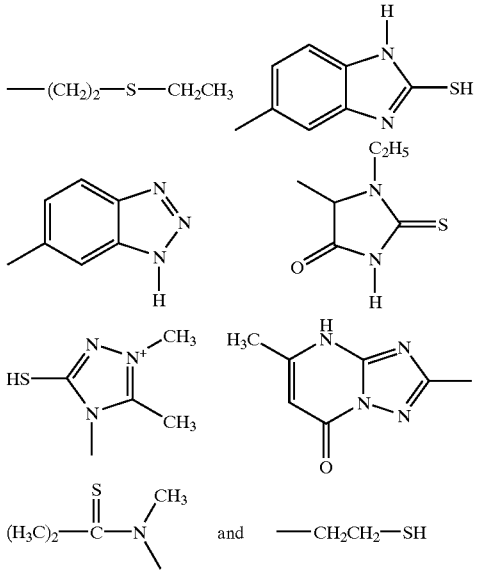

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

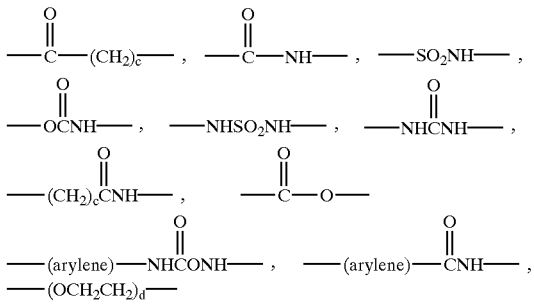

where c = 1–30, and d = 1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

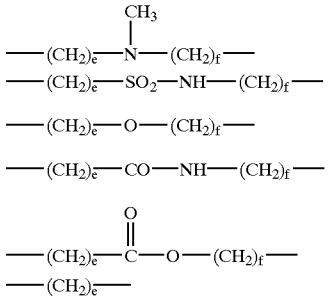

e and f = 1–30, with the proviso that e + f ≤ 31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

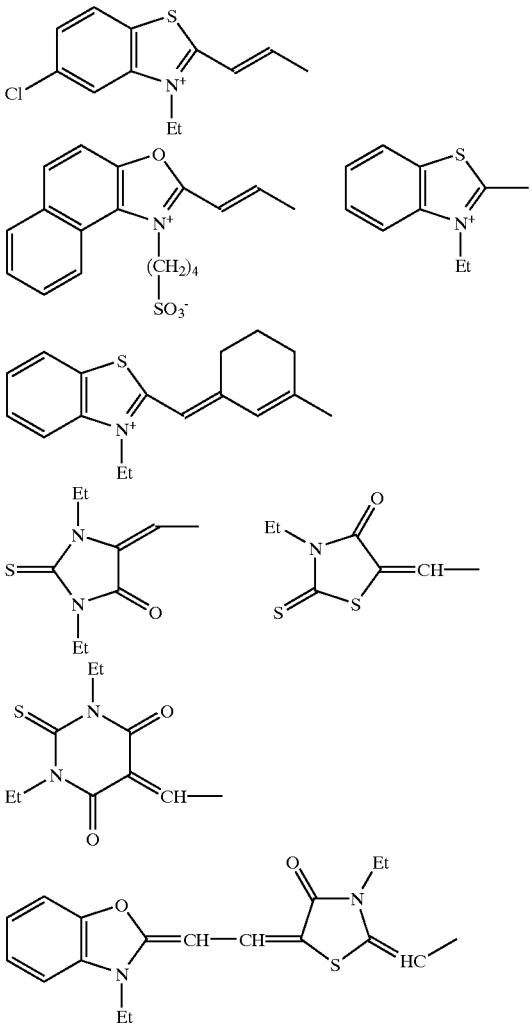

Particularly preferred are Q groups of the formula:

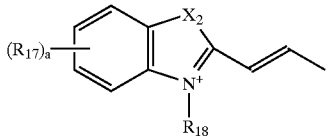

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1

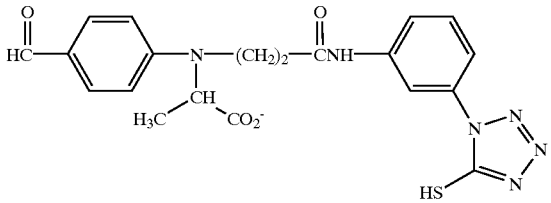

FED 2

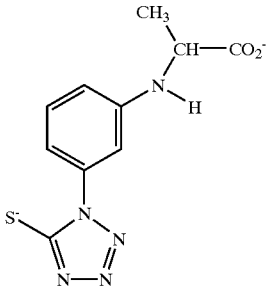

FED 3

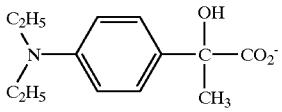

FED 4

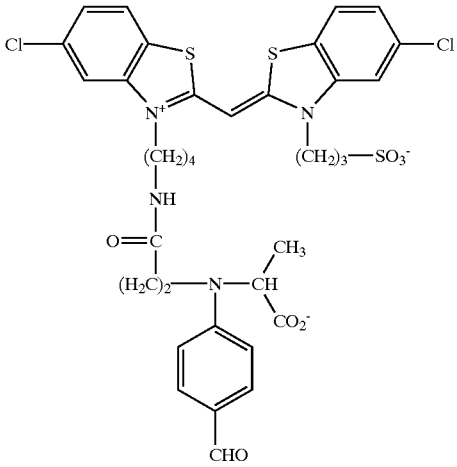

FED 5

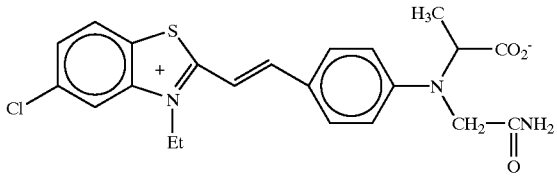

FED 6

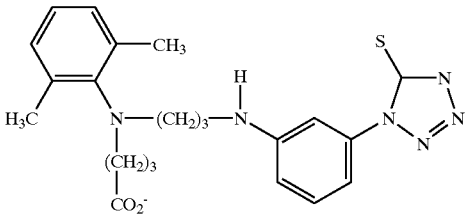

FED 7

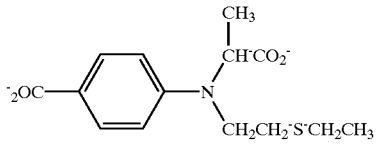

FED 8

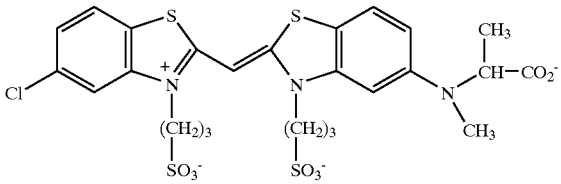

-continued
FED 9
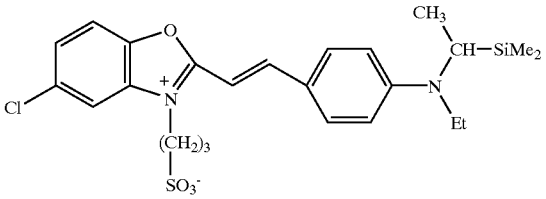
FED 10
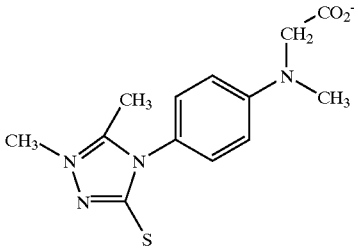
FED 11
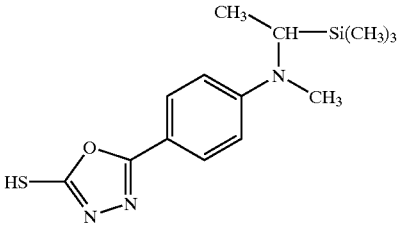
FED 12
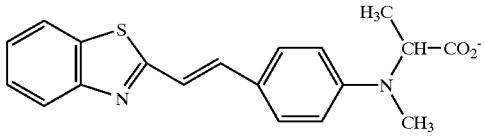
FED 13
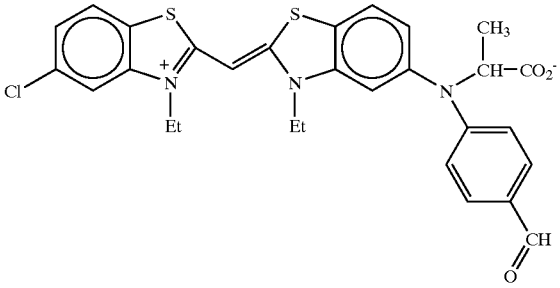
FED 14
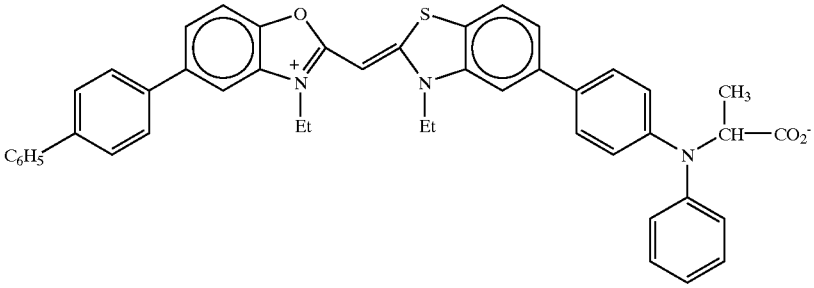
FED 15
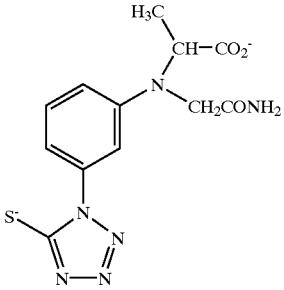
FED 16
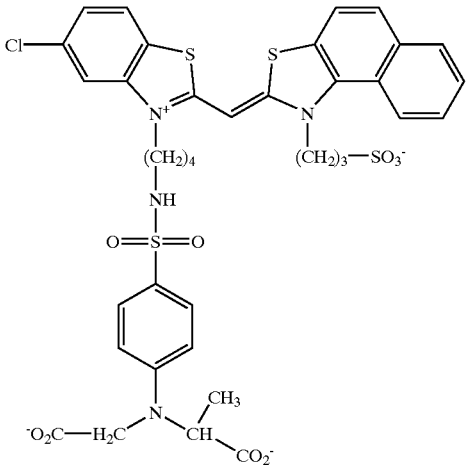

-continued

FED 17

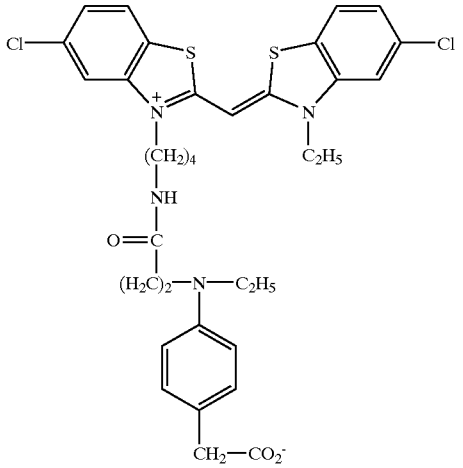

FED 18

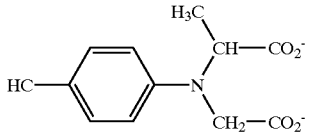

FED 19

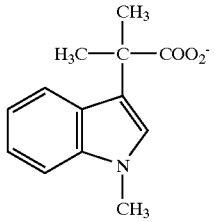

FED 20

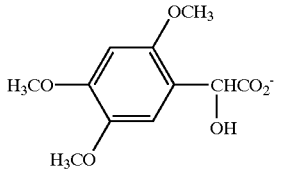

FED 21

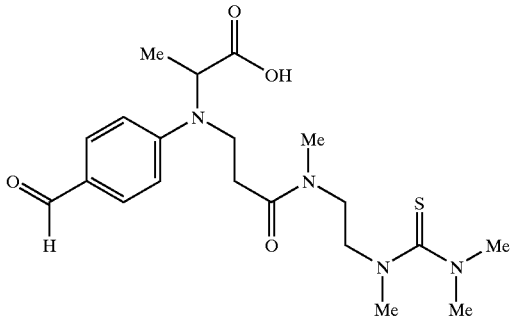

FED 22

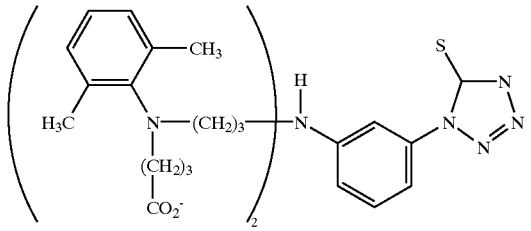

Fragmentable electron donating compounds are described more fully in U.S. Pat. Nos. 5,747,235 and 5,747,236 and commonly assigned co-pending U.S. applications Ser. No. 08/739,911 filed Oct. 30, 1996, and Ser. Nos. 09/118,536, 09/118,552 and 09/118,714 filed Jul. 25, 1998, the entire disclosures of these patents and patent applications are incorporated herein by reference.

In a preferred embodiment, the photographic element contains a blue sensitive emulsion with a blue spectral sensitization and enhanced speed. For example, the emulsion may be sensitized with a dye of formula VII or with the combination of a dye of formula (VI) and a dye of formula (VII), wherein the formula (VI) dye on the emulsion has a peak sensitization between 400–445 nm and the formula (VII) dye on the emulsion has a peak sensitization between 446–500 nm.

(VI)

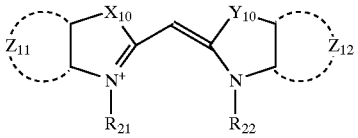

-continued (VII)

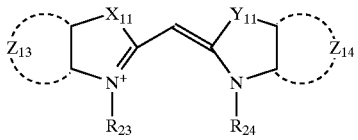

wherein:

$Z_{11}$, $Z_{12}$, $Z_{13}$, and $Z_{14}$ independently represent the atoms necessary to complete a substituted or unsubstituted benzene or naphthylene;

$X_{10}$, $Y_{10}$, $X_{11}$ and $Y_{11}$ are independently O, S, Se or $NR_{25}$, provided that at least $X_{10}$ or $Y_{10}$ is O or $NR_{25}$, wherein $R_{25}$ is an alkyl, alkenyl or aryl (preferably alkyl or aryl), any of which may be substituted or unsubstituted;

$R_{21}$, $R_{22}$, $R_{23}$ and $R_{24}$ independently represent an alkyl, alkenyl or aryl group (preferably alkyl or aryl), any or which may be substituted or unsubstituted.

In the above and throughout this application, it will be understood that reference to a substituted or unsubstituted benzene ring does not include a benzene ring with other annellated aromatic rings. Thus, a substituted or unsubstituted benzene ring does not include naphthylene or higher fused ring systems. Similarly, reference to substituted or unsubstituted naphthylene does not include anthracene or higher fused ring systems.

In the formula (VI) and (VII), $R_{21}$, $R_{22}$, $R_{23}$ and $R_{24}$ may particularly be a substituted or unsubstituted lower alkyl (that is, from 1 to 6 carbon atoms), or may preferably be a substituted or unsubstituted I to 4 carbon atom alkyl. The dye of formula (VI) may particularly be selected to provide a peak sensitivity, on the emulsion, of between 430 to 444 nm, more preferably 430–440 nm and most preferably 433–437 nm. A color photographic element of the present invention may have a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer. The blue sensitive silver layer may be of the above described tabular type sensitized with a dye of formula (VI) and a dye of formula (VII), as already described, such that the sensitized emulsion meets the limitations as defined in U.S. Pat. No. 5,460,928, the entire disclosure of which is incorporated herein by reference. Alternatively, such blue sensitized tabular grain emulsion may be sensitized with dyes of formula VI or VII so as to meet the sensitivity limitations defined in U.S. Pat. No. 5,576,157, the entire disclosure of which is incorporated herein by reference. The foregoing applications and any other references cited herein are incorporated in this application by reference.

For example, the blue sensitive tabular emulsion layer may be sensitized with dyes of formula (VI) and (VII) in accordance with U.S. Pat. No. 5,576,157, such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\text{ nm}=\lambda_{Bmax}=440\text{ nm or }450\text{ nm}=\lambda_{Bmax}=480\text{ nm}$$

and:

$$S_{485}=50\%\ (S_{Bmax})$$

$$S_{410}=60\%\ (S_{Bmax})$$

and the maximum sensitivity of the emulsion between 430–440 nm ("$S_{(430\text{-}440)max}$"), and the maximum sensitivity between 450–480 nm ("$S_{(450\text{-}480)max}$"), have the following relationship:

$$90\%\ (S_{450\text{-}480)max})=S_{(430\text{-}440)max}=110\%\ (S_{(450\text{-}480)max}).$$

As to the amounts of dyes of formula (VII) or of the combination of dyes of formula (VI) and formula (VII) that would be used, the total amount of a dye used alone or of both dyes when used together would typically be between 0.1 to 5 millimoles of dye per mole of silver halide (mmoles/mole). Preferably, the total amount would be between 0.5 mmoles/mole to 3 mmoles/mole. As to the molar ratios of dyes (VI) to (VII), the ratio of (VI):(VII) would typically be between 1:4 to 4:1 and or even between 1:3 to 2:1.

Illustrative dyes of formula (VI) include, for example:

VI-1

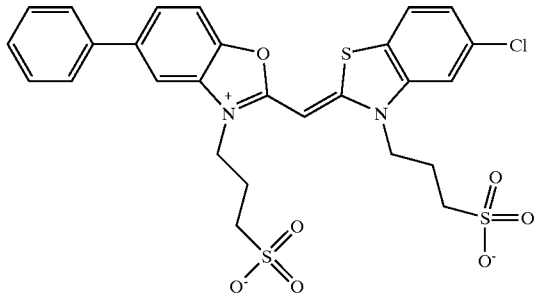

VI-2

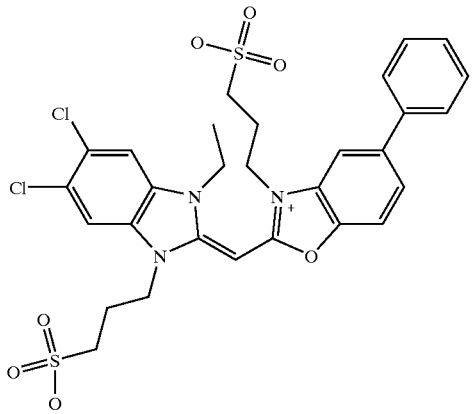

VI-3

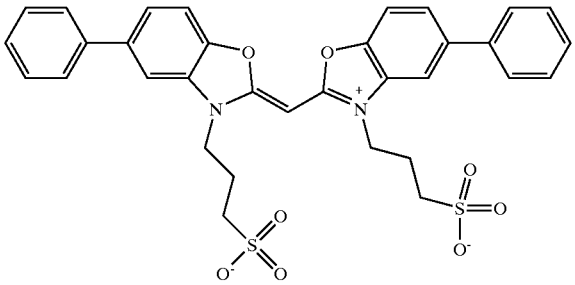

VI-4

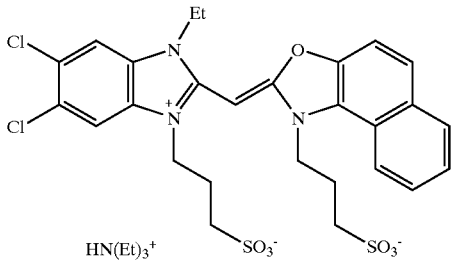

VI-5

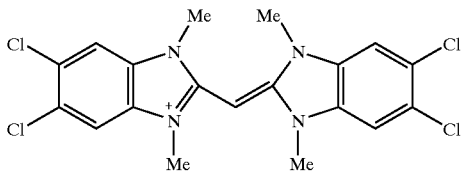

pts.

-continued
VI-6
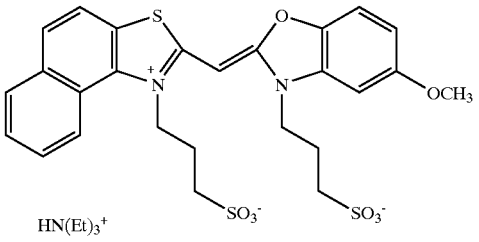
VI-7
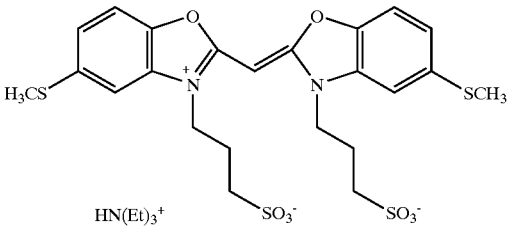
Illustrative dyes of formula (VII) include, for example:
VII-1
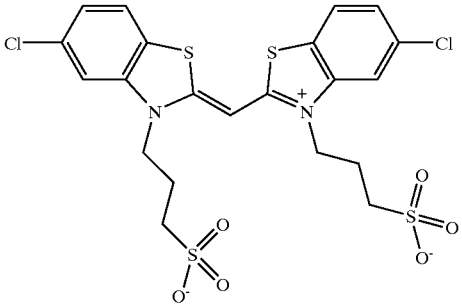
VII-2
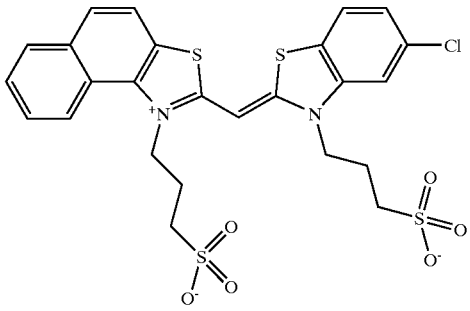
VII-3
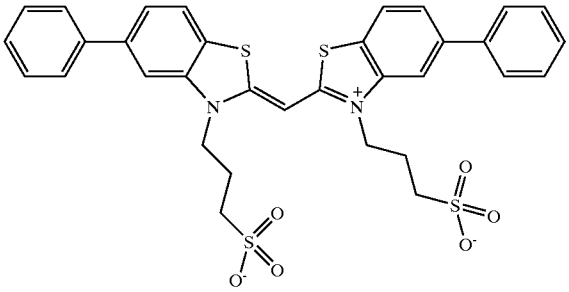
-continued
VII-4
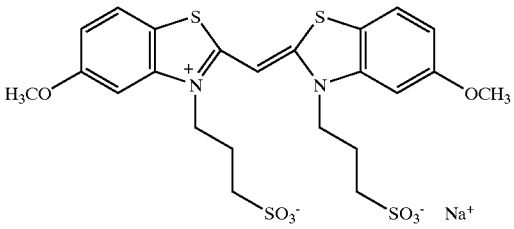
VII-5
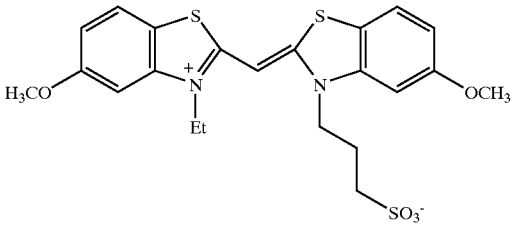
VII-6
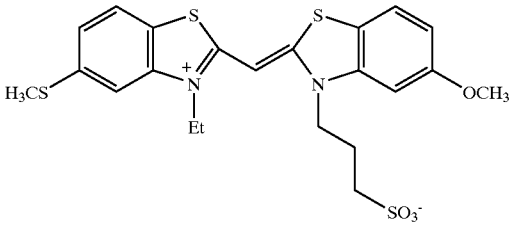
VII-7
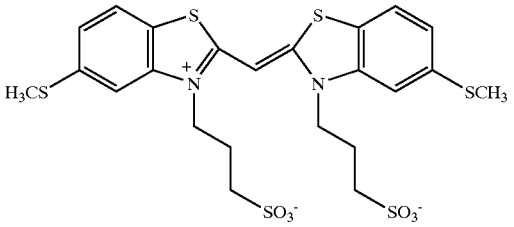
VII-8
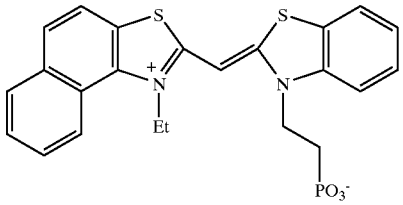
VII-9
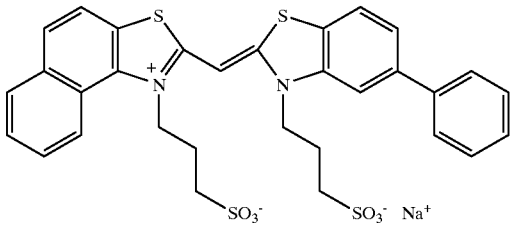

-continued

VII-10

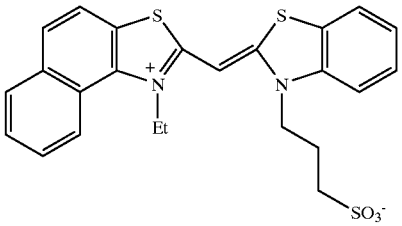

VII-11

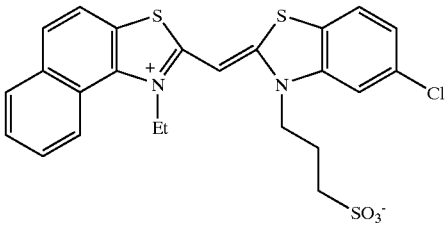

VII-12

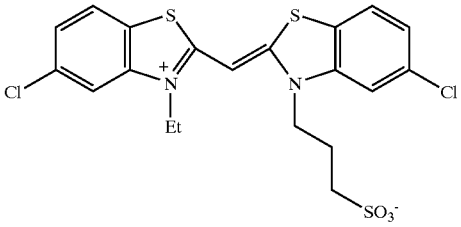

VII-13

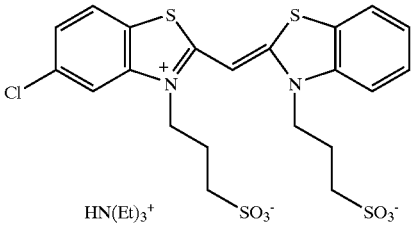

VII-14

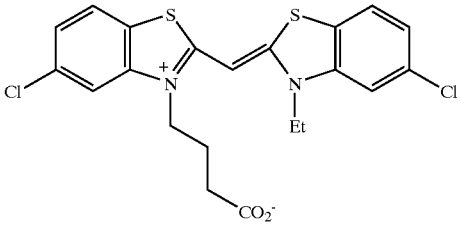

The emulsion layer of the photographic element of the invention can comprise any one or more of the light sensitive layers of the photographic element. The photographic elements made in accordance with the present invention are multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which is preferably transparent.

Image dye forming couplers that can be used in the multilayer photographic element of the incention include, for example:

Couplers which combine with oxidized developer to produce cyan colored dyes are shown, for example, in Weissberger et al U.S. Pat. No. 2,474,293, Vittum et al U.S. Pat. No. 3,002,836, Stecker U.S. Pat. No. 3,041,236, Ono et al U.S. Pat. No. 4,746,602, Kilminster U.S. Pat. No. 4,753,871, Aoki et al U.S. Pat. No. 4,770,988, Kilminster et al U.S. Pat. No. 4,775,616, Hamada et al U.S. Pat. No. 4,818,667, Masukawa et al U.S. Pat. No. 4,818,672, Monbaliu et al U.S. Pat. No. 4,822,729, Monbaliu et al U.S. Pat. No. 4,839,267, Masukawa et al U.S. Pat. No. 4,840,883, Hoke et al U.S. Pat. No. 4,849,328, Miura et al U.S. Pat. No. 4,865,961, Tachibana et al U.S. Pat. No. 4,873,183, Shimada et al U.S. Pat. No. 4,883,746, Tani et al U.S. Pat. No. 4,900,656, Ono et al U.S. Pat. No. 4,904,575, Tachibana et al U.S. Pat. No. 4,916,051, Nakayama et al U.S. Pat. No. 4,921,783, Merkel et al U.S. Pat. No. 4,923,791, Tachibaba et al U.S. Pat. No. 4,950,585, Aoki et al U.S. Pat. No. 4,971,898, Lau U.S. Pat. No. 4,990,436, Masukawa et al U.S. Pat. No. 4,996,139, Merkel U.S. Pat. No. 5,008,180, Wolff U.S. Pat. No. 5,015,565, Tachibana et al U.S. Pat. No. 5,011,765, Kida et al U.S. Pat. No. 5,011,766, Masukawa et al U.S. Pat. No. 5,017,467, Hoke U.S. Pat. No. 5,045,442, Uchida et al U.S. Pat. No. 5,051,347, Kaneko U.S. Pat. No. 5,061,613, Kita et al U.S. Pat. No. 5,071,737, Langen et al U.S. Pat. No. 5,075,207, Fukunada et al U.S. Pat. No. 5,091,297, Tsukahara et al U.S. Pat. No. 5,094,938, Shimada et al U.S. Pat. No. 5,104,783, Fujita et al U.S. Pat. No. 5,178,993, Naito et al U.S. Pat. No. 5,813,729, Ikesu et al U.S. Pat. No. 5,187,057, Tsukahara et al U.S. Pat. No. 5,192,651, Schumann et al U.S. Pat. No. 5,200,305, Yamakawa et al U.S. Pat. No. 5,202,224, Shimada et al U.S. Pat. No. 5,206,130, Ikesu et al U.S. Pat. No. 5,208,141, Tsukahara et al U.S. Pat. No. 5,210,011, Sato et al U.S. Pat. No. 5,215,871, Kita et al U.S. Pat. No. 5,223,386, Sato et al U.S. Pat. No. 5,227,287, Suzuki et al U.S. Pat. No. 5,256,526, Kobayashi et al U.S. Pat. No. 5,258,270, Shimada et al U.S. Pat. No. 5,272,051, Ikesu et al U.S. Pat. No. 5,306,610, Yamakawa U.S. Pat. No. 5,326,682, Shimada et al U.S. Pat. No. 5,366,856, Naruse et al U.S. Pat. No. 5,378,596, Takizawa et al U.S. Pat. No. 5,380,638, Lau et al U.S. Pat. No. 5,382,502, Matsuoka et al U.S. Pat. No. 5,384,236, Takada et al U.S. Pat. No. 5,397,691, Kaneko et al U.S. Pat. No. 5,415,990, Asami U.S. Pat. No. 5,434,034, Tang et al U.S. Pat. No. 5,441,863, Tashiro et al EPO 0 246 616, Lau EPO 0 250 201, Kilminster et al EPO 0 271 323, Sakanoue et al EPO 0295 632, Mihayashi et al EPO 0 307 927, Ono et al EPO 0 333 185, Shinba et al EPO 0 378 898, Giusto EPO 0 389 817, Sato et al EPO 0 487 111, Suzuki et al EPO 0 488 248, Ikesu et al EPO 0 539 034, Suzuki et al EPO 0 545 300, Yamakawa et al EPO 0 556 700, Shimada et al EPO 0 556 777, Kawai EPO 0 556 858, Yoshioka EPO 0 569 979, Ikesu et al EPO 0 608 133, Merkel et al EPO 0 636 936, Merkel et al EO 0 651 286, Sugita et al EPO 0 690 344, Renner et al German OLS 4,026,903, Langen et al German OLS 3,624,777 and Wolff et al German OLS 3,823,049;

Magenta coupler types are shown, for example, in Porter et al U.S. Pat. Nos. 2,311,082 and 2,369,489, Tuite U.S. Pat. No. 3,152,896, Arai et al U.S. Pat. No. 3,935,015, Renner U.S. Pat. No. 4,745,052, Ogawa et al U.S. Pat. No. 4,762, 775, Kida et al U.S. Pat. No. 4,791,052, Wolff et al U.S. Pat. No. 4,812,576, Wolff et al U.S. Pat. No. 4,835,094, Abe et al U.S. Pat. No. 4,840,877, Wolff U.S. Pat. No. 4,845,022, Krishnamurthy et al U.S. Pat. No. 4,853,319, Renner U.S. Pat. No. 4,868,099, Helling et al U.S. Pat. No. 4,865,960, Normandin U.S. Pat. No. 4,871,652, Buckland U.S. Pat. No. 4,876,182, Bowne et al U.S. Pat. No. 4,892,805, Crawley et al U.S. Pat. No. 4,900,657, Furutachi U.S. Pat. No. 4,910, 124, Ikesu et al U.S. Pat. No. 4,914,013, Yokoyama et al U.S. Pat. No. 4,921,968, Furutachi et al U.S. Pat. No. 4,929,540, Kim et al U.S. Pat. No. 4,933,465, Renner U.S. Pat. No. 4,942,116, Normandin et al U.S. Pat. No. 4,942,117, Normandin et al U.S. Pat. No. 4,942,118, Normandin et al U.S. Pat. No. 4,959,480, Shimazaki et al U.S. Pat. No. 4,968,594, Ishige et al U.S. Pat. No. 4,988,614, Bowne et al U.S. Pat. No. 4,992,361, Renner et al U.S. Pat. No. 5,002, 864, Bums et al U.S. Pat. No. 5,021,325, Sato et al U.S. Pat. No. 5,066,575, Morigaki et al U.S. Pat. No. 5,068,171, Ohya et al U.S. Pat. No. 5,071,739, Chen et al U.S. Pat. No. 5,100,772, Harder et al U.S. Pat. No. 5,110,942, Kimura et al U.S. Pat. No. 5,116,990, Yokoyama et al U.S. Pat. No. 5,118,812, Kunitz et al U.S. Pat. No. 5,134,059, Mizukawa et al U.S. Pat. No. 5,155,016, Romanet et al U.S. Pat. No. 5,183,728, Tang et al U.S. Pat. No. 5,234,805, Sato et al U.S. Pat. No. 5,235,058, Krishnamurthy et al U.S. Pat. No. 5,250,400, Ikenoue et al U.S. Pat. No. 5,254,446, Krishnamurthy et al U.S. Pat. No. 5,262,292, Matsuoka et al U.S. Pat. No. 5,300,407, Romanet et al U.S. Pat. No. 5,302,496, Daifuku et al U.S. Pat. No. 5,336,593, Singer et al U.S. Pat. No. 5,350,667, Tang U.S. Pat. No. 5,395,968, Helling et al U.S. Pat. No. 5,354,826, Tang et al U.S. Pat. No. 5,358,829, Ishidai et al U.S. Pat. No. 5,368,998, Krishnamurthy et al U.S. Pat. No. 5,378,587, Mizukawa et al U.S. Pat. No. 5,409,808, Signer et al U.S. Pat. No. 5,411,841, Wolff U.S. Pat. No. 5,418,123, Tang U.S. Pat. No. 5,424,179, Numata et al EPO 0 257 854, Bowne et al EPO 0284 240, Webb et al EPO 0 341 204, Miura et al EPO 347,235, Yukio et al EPO 365,252, Yamazaki et al EPO 0 422 595, Kei EPO 0 428 899, Tadahisa et al EPO 0428 902, Hieechi et al EPO 0459 331, Sakanoue et al EPO 0467 327, Kida et al, EPO 0476 949, Kei et al, EPO 0487 081, Wolfe EPO 0489 333, Coraluppi et al EPO 0 512 304, Hirabayashi et al EPO 0 515 128, Harabayashi et al EPO 0 534703, Sato et al EPO 0 554778, Tang et al EPO 0558 145, Mizukawa et al EPO 0 571 959, Schofield et al EPO 0 583 832, Schofield et al EPO 0 583 834, Hirabayashi et al EPO 0 584 793, Tang et al EPO 0 602 748, Tang et al EPO 0 602 749, Lau et al EPO 0 605 918, Allway EPO 0 622 672, Allway EPO 0 622 673, Kita et al EPO 0 629 912, Kapp et al EPO 0 646 841, Kita et al EPO 0 656 561, Ishidai et al EPO 0 660 177, Tanaka et al EPO 0 686 872, Thomas et al WO 90/10253, Williamson et al WO 92/09010, Leyshon et al, WO 92/10788, Crawley et al WO 92/12464, Williamson WO 93/01523, Merkel et al WO 93/02392, Krishnamurthy et al WO 93/02393, Williamson WO 93/07534, UK Patent Application 2,244,053, Japanese Patent Application 03192-350, Renner German OLS 3,624, 103, Wolff et al German OLS 3,912,265, and Werner et al German OLS 40 08 067; and Compounds useful for forming yellow colored dyes upon coupling with oxidized color developer include, for example, Weissberger U.S. Pat. No. 2,298,443, Okumura et al U.S. Pat. No. 4,022,620, Buckland et al U.S. Pat. No. 4,758,501, Ogawa et al U.S. Pat. No. 4,791,050, Buckland et al U.S. Pat. No. 4,824,771, Sato et al U.S. Pat. No. 4,824,773, Renner et al U.S. Pat. No. 4,855,222, Tsoi U.S. Pat. No. 4,978,605, Tsuruta et al U.S. Pat. No. 4,992,360, Tomotake et al U.S. Pat. No. 4,994,361, Leyshon et al U.S. Pat. No. 5,021,333, Masukawa U.S. Pat. No. 5,053,325, Kubota et al U.S. Pat. No. 5,066,574, Ichijima et al U.S. Pat. No. 5,066,576, Tomotake et al U.S. Pat. No. 5,100,773, Lau et al U.S. Pat. No. 5,118,599, Kunitz U.S. Pat. No. 5,143, 823, Kobayashi et al U.S. Pat. No. 5,187,055, Crawley U.S. Pat. No. 5,190,848, Motoki et al U.S. Pat. No. 5,213,958, Tomotake et al U.S. Pat. No. 5,215,877, Tsoi U.S. Pat. No. 5,215,878, Hayashi U.S. Pat. No. 5,217,857, Takada et al U.S. Pat. No. 5,219,716, Ichijima et al U.S. Pat. No. 5,238, 803, Kobayashi et al U.S. Pat. No. 5,283,166, Kobayashi et al U.S. Pat. No. 5,294,531, Mihayashi et al U.S. Pat. No. 5,306,609, Fukuzawa et al U.S. Pat. No. 5,328,818, Yamamoto et al U.S. Pat. No. 5,336,591, Saito et al U.S. Pat. No. 5,338,654, Tang et al U.S. Pat. No. 5,358,835, Tang et al. U.S. Pat. No. 5,358,838, Tang et al U.S. Pat. No. 5,360,713, Morigaki et al U.S. Pat. No. 5,362,617, Tosaka et al U.S. Pat. No. 5,382,506, Ling et al U.S. Pat. No. 5,389,504, Tomotake et al U.S. Pat. No. 5,399,474, Shibata U.S. Pat. No. 5,405, 737, Goddard et al U.S. Pat. No. 5,411,848, Tang et al U.S. Pat. No. 5,427,898, Himmelmann et al EPO 0 327 976, Clark et al EPO 0 296 793, Okusa et al EPO 0 365 282, Tsoi EPO 0 379 309, Kida et al EPO 0 415 375, Mader et al EPO 0 437 818, Kobayashi et al EPO 0 447 969, Chino et al EPO 0 542 463, Saito et al EPO 0 568 037, Tomotake et al EPO 0 568 196, Okumura et al EPO 0 568 777 and Yamada et al EPO 0 570 006, Kawai EPO 0 573 761, Carmack et al EPO 0 608 956, Carmack et al EPO 0 608 957, Mooberry et al EPO 0 628 865.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comrpise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; U.S. Pat. Nos. DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

As discussed above, at least one of the layers of the photographic element of this invention comprises tabular grain silver halide emulsions. Tabular grains are those with two parallel major faces each clearly larger than any remaining grain face and tabular grain emulsions are those in which the tabular grains account for at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. The tabular grains preferably have an average equivalent circular diameter of at least 2 $\mu$m, more preferably at least 3 $\mu$m, and most preferably 4 $\mu$m Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B.(3) (page 503).

The silver halide used in the photographic element of the present invention may be silver iodobromide, silver bromide, silver chloride, silver chlorobromide, silver chloroiodobromide, and the like.

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SETand non-SET Ir dopants singly or in combination. For example, grains containing a combination of an SET dopant and a non-SET Ir dopant are specifically contemplated.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

The sensitization of the silver halide with the dyes of formula VI and VII may be carried out by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor,

*The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Patent No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The fragmentable electron donating sensitizer compounds of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion.

The amount of fragmentable electron donating compound which is employed in this invention may range from as little as $1\times10^{-8}$ mole to as much as about 0.1 mole per mole of silver in an emulsion layer, preferably from as little as $5\times10^{-7}$ mole to as much as about 0.01 mole per mole of silver in an emulsion layer. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed.

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

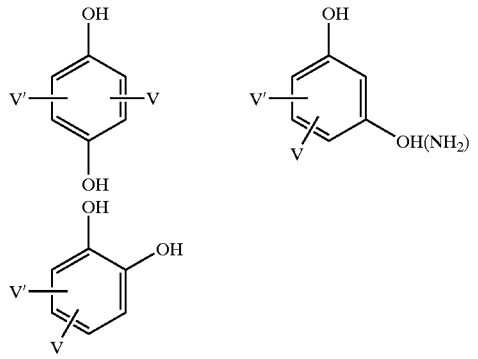

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, $—CH_2CH_2COOH$, $—CH_3$, $—CH_2CH_3$, $—C(CH_3)_3$, $—OCH_3$, —CHO, $—SO_3K$, $—SO_3Na$, $—SO_3H$, $—SCH_3$, or -phenyl.

Especially preferred hydroxybenzene compounds follow:

HB1

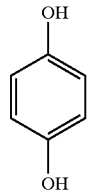

-continued

HB2

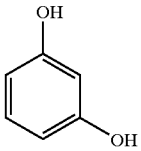

HB3

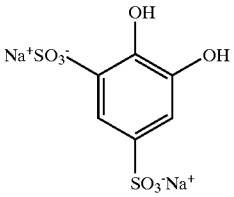

HB4

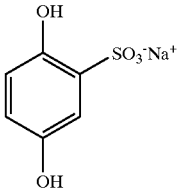

HB5

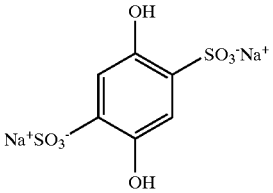

HB6

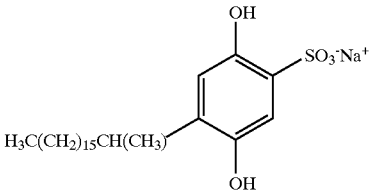

HB7

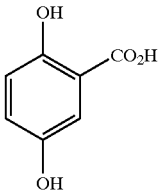

HB8

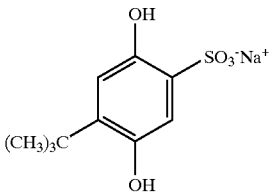

HB9

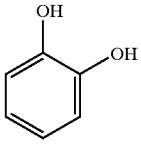

-continued

HB10

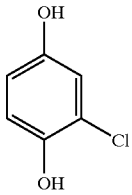

HB11

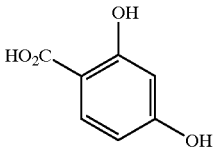

HB12

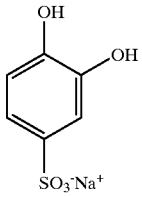

HB13

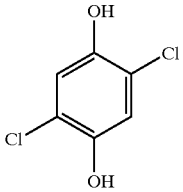

HB14

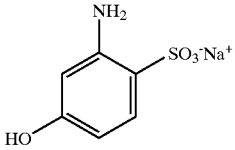

HB15

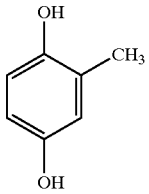

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

The following examples illustrate the preparation and evaluation of photographic elements of the invention.

EMULSION EXAMPLES

E-1

A 180 L reactor charged with 52.7 kg of distilled water and containing 131 g of NaBr and 564 g of gelatin was adjusted to 70 C. The contents of the reactor were stirred vigorously throughout the precipitation process. 15.9 moles of AgI Lippmann emulsion were then dumped in and following a 4 minute hold, 1.25 M AgNO3 solution was run in at a linearly accelerated rate of 177 to 285 g/min over 9.4 minutes. Next, 1.25 M AgNO3 and 2.50 M NaBr solutions were added at linearly accelerated rates of 285 to 547 g/min and 116 to 416 g/min, respectively, for 21.8 minutes. Following this segment, 2.50 M AgNO3 and 2.50 M NaBr solutions were double jetted at accelerated rates of 313 to 1414 g/min and 416 g/min to 1272 g/min, respectively, over a 40.9 minute period. After this time, only the AgNO3 flow was continued and at a decelerated rate over the final 21.4 minutes during which the reactor vAg increased to +40 mv. The resulting emulsion grains had a mean equivalent circular diameter of 1.4 $\mu$m, and bromide accounted for 86% of the total emulsion halide.

The emulsion was optimally chemically and spectrally sensitized by adding KCl, NaSCN, $9.96\times10^{-5}$ mole/mole Ag of the blue sensitizing dye VII-1 , $Na_2S_2O_3.5H_2O$, $Na_3Au(S_2O_3)_2.2H_2O$, and a benzothiazolium finish modifier. The emulsion was then subjected to a heat cycle to 65° C. The antifoggant-stabilizer, tetraazaindene, at a concentration of $8.71\times10^{-3}$ mole/mole silver, was added to the emulsion melt after the chemical sensitization procedure.

E-2

An AgBrI tabular silver halide emulsion (Emulsion E-2) was prepared containing 2% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 $\mu$m and average circular diameter of 4.5 $\mu$m. The emulsion was precipitated using deionized gelatin and contained 0.53 molar parts per million of KSeCN per silver mole introduced at 80% of the precipitation. The emulsion was optimally chemically and spectrally sensitized by adding NaSCN, $7.26\times10^{-4}$ mole/mole Ag of the blue sensitizing dye VII-1, a mercaptotetrazole antifogging agent, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $1.02\times10^{-2}$ mole/mole silver, was added to the emulsion melt after the chemical sensitization procedure. For variations containing FED-2 as specified in Table 1, the antifoggant HB3 was added at a concentration of $1.29\times10^{-2}$ mole/mole silver followed by 0.3 mg of FED-2/mole Ag.

E-3

An AgBrI tabular silver halide emulsion (Emulsion E-3) was prepared containing 7.8% silver iodide. The emulsion grains had an average equivalent circular diameter of 3.3 $\mu$m and an average thickness of 0.26 $\mu$m. The first 15% of the silver added contained no iodide and was precipitated in the manner of Tsaur et al., U.S. Pat. Nos. 5,147,771–3, except the block copolymer Pluronic L43™ was substituted for the block copolymer Pluronic 31R1™. The next 45% of the added silver contained a silver bromoiodide phase, 10% iodide, precipitated from AgI seeds in oxidized gelatin and grown at a pBr of 1.52. The next 10% of the added silver was precipitated as AgBr. From 56–60% of the added silver, 50 mppm ruthenium hexacyanide was added. At 70% of the added silver the pBr was adjusted to 1.13. 0.5 mppm selenocyanic acid and 3% AgI seeds were added. The pBr was adjusted to 2.38 by a single jet addition of silver solution (~17% of the total silver). The remaining 10% of the silver was precipitated as a double jet AgBr phase. The emulsion was optimally chemically and spectrally sensitized at 40° C. by adding sodium thiocyanate, $5.01\times10^{-4}$ mole/mole of silver, benzothiazolium, 3-(3-((methylsulfonyl)amino)-3-oxopropyl)-, tetrafluoroborate(1–), $5.65\times10^{-5}$ mole/mole of silver, a blue sensitizing dye BSD-1, $4.25\times10^{-4}$ moles/mole of silver, a sulfur sensitizer carboxymethyl-trimethylthiourea, $2.27\times10^{-6}$ mole/mole of silver, and a gold sensitizer bis(1,3,5-trimethyl-1,2,4-triazolium-3-thiolate) gold(I) tetrafluoroborate, $7.89\times10^{-7}$ mole/mole of silver. The emulsion was subsequently subjected to a heat cycle to 62.5° C. The sodium salt of tetraazaindene, at a concentration of $1.02\times10^{-2}$ mole/mole of silver, was added to the emulsion melt after the chemical sensitization procedure. For variations containing FED-2 as specified in Table 2, the antifoggant HB3 was added at a concentration of $1.29\times10^{-2}$ mole/mole silver followed by 0.1 mg of FED-2/mole Ag.

MULTILAYER EXAMPLES

ML-A-1

The Multilayer Film Structure utilized for this example is shown below, with structures of components immediately following. Component laydowns are provided in units of gm/sq m. (Bislvinylsulfonyl)methane hardener atl.55% of total gelatin weight. Antifoggants (including 4-hydroxy-6-methyl-1,3,3a,7-tetraazaindene), surfactants, coating aids, coupler solvents, emulsion addenda, sequestrants, lubricants, matte and tinting dyes were added to the appropriate layers as is common in the art.

Layer 1 (Protective Overcoat Layer): gelatin at 0.89.

Layer 2 (UV Filter Layer): silver bromide Lippman emulsion at 0.269, UV-1 and UV-2 both at 0.108 and gelatin at 0.818.

Layer 3 (Fast Yellow Layer): blue sensitized silver iodobromide 3d emulsion (E-1) coated at 1.34, YC-1 at 0.420, IR-1 at 0.027, B-1 at 0.011 and gelatin at 2.26.

Layer 4 (Slow Yellow Layer): a blend of three blue sensitized (all with BSD-1) tabular silver iodobromide emulsions (i) 1.3×0.13 $\mu$m, 4.5 mole % I at 0.333, (ii) 0.8×0.12 $\mu$m, 1.5 mole % I at 0.269, (iii) ) 0.77×0.14 $\mu$m, 1.5 mole % I at 0.2 1 5, yellow dye forming coupler YC-1 at 0.732, IR-1 at 0.027 and gelatin at 2.26.

Layer 5 (Yellow filter layer): YFD-1 at 0.108, OxDS-1 at 0.075 and gelatin at 0.807.

Layer 6 (Fast Magenta Layer): a green sensitized (with a mixture of GSD-1 and GSD-2) silver iodobromide tabular emulsions (3.9×0.14 $\mu$m, 3.7 mole % iodide) at 1.29, magenta dye forming coupler MC-1 at 0.084, IR-2 at 0.003 and gelatin at 1.58.

Layer 7 (Mid Magenta Layer): a green sensitized (with a mixture of GSD-1 and GSD-2) silver iodobromide tabular emulsions: (i) 2.9×0.12 $\mu$m, 3.7 mole % iodide at 0.969, magenta dye forming coupler MC-1 at 0.082, Masking Coupler MM-1 at 0.086, IR-2 at 0.011 and gelatin at 1.56.

Layer 8 (Slow magenta layer): a blend of two green sensitized (both with a mixture of GSD-1 and GSD-2) silver iodobromide tabular emulsions: (i) 0.88×0.12 $\mu$m, 2.6 mole % iodide at 0.537 and (ii) 1.2×0.12 $\mu$m, 4.1 mole % iodide at 0.342, magenta dye forming coupler MC-1 at 0.285, Masking Coupler MM-1 at 0.075 and gelatin at 1.18.

Layer 9 (Interlayer): OxDS-1 at 0.075 and gelatin at 0538.

Layer 10 (Fast Cyan layer): a red-sensitized sensitized (with a mixture of RSD-1 and RSD-2) iodobromide tabular emulsion (4.0×0.13 $\mu$m, 4.0 mole % I) at 0.130, cyan dye-forming coupler CC-2 at 0.205, IR-4 at 0.025, IR-3 at 0.022, OxDS-1 at 0.014 and gelatin at 1.45.

Layer 11 (Mid Cyan Layer): a red-sensitized sensitized (all with a mixture of RSD-1 and RSD-2) iodobromide tabular emulsion (2.2×0.12 $\mu$m, 3.0 mole % I) at 1.17, cyan dye-forming coupler CC-2 at 0.181, IR-4 at 0.011, masking coupler CM-1 at 0.032, OxDS-1 at 0.011 and gelatin at 1.61.

Layer 12 (Slow cyan layer): a blend of two red sensitized (all with a mixture of RSD-1 and RSD-2) silver iodobromide emulsions: (i) a large sized iodobromide tabular grain emulsion (1.2×0.12 μm, 4.1 mole % I) at 0.265, (ii) a smaller iodobromide tabular emulsion (0.74×0.12), 4.1 mole % I) at 0.312, cyan dye-forming coupler CC-1 at 0.227, CC-2 at 0.363, masking coupler CM-1 at 0.032, bleach accelerator releasing coupler B-1 at 0.080 and gelatin at 1.67.

Layer 13 (Interlayer): OxDS-1 at 0.075 and gelatin at 0538.

Layer 14 (Antihalation layer): Black Colloidal Silver at 0.151, UV-1 and UV-2 both at 0.075 and gelatin at 1.61.

Support: cellulose triacetate

ML-A-2 is like ML-A-1 with the following change:

Layer 3 (Fast Yellow layer): Emulsion E-2 was used instead of E-1.

ML-A-3 is like ML-A-2 with the following change:

Layer 3 (Fast Yellow layer): FED-2 was added to Emulsion E-2 as specified in the description of Emulsion E-2.

Blue Speed: Samples of each element were given a stepped exposure to a light source with an effective color temperature of 5500oK and processed in the KODAK FLEXICOLOR (C-41) process as described in *British Journal of Photography Annual,* 1988, pp 196–198. Speed was measured in relative log units as 100*(1-logH) where H is the exposure in lux-sec necessary to produce a density 0.15 above D-min. Relative speed was set equal to 100 for the multilayer element containing the large 3D emulsion in the fast yellow layer (Variation 1).

Delta % RMS Blue Granularity: Granularity of the blue layer in a neutral exposure was determined by the RMS method (see The Theory of the Photographic Process, $4^{th}$ Edition, T. H. James, pp 625–628) using a 48 micron aperture at a density either 0.4 or 1.0 log exposure units from the speed point at 0.15 density units above the fog level. (See tables for specific values.) RMS values are a measure of the standard deviation of density at various densities. Lower RMS granularity values indicate improved photographic performance. Delta % RMS Blue granularity of neutral exposures were compared relative to the check (ML-A-1). Negative delta % RMS Blue Granularity values indicate a desirable improvement in photographic performance. A 6% change in RMS Granularity offers a noticeable improvement in graininess as described by D. Zwick and D. Brothers, (*J. Soc. Mot. Pict. Telev. Eng.,* v86, p427–430, 1977).

Red Acutance: To evaluate acutance, the film samples were exposed using white light to sinusoidal patterns to determine the Modulation Transfer Function (MTF) Percent Response as a function of spatial frequency in the film plane. Specific details of this exposure-evaluation cycle can be found at R. L. Lamberts and F. C. Eisen, "A System for the Automated Evaluation of Modulation Transfer Functions of Photographic Materials", in the Journal of Applied Photographic Engineering, vol. 6. Pages 1–8, February 1980. A more general description of the determination and meaning of MTF Percent Response curves can be found in the articles cited within this reference. The exposed samples were developed and bleached in the KODAK FLEXICOLOR (C-41) process The exposed and processed samples were evaluated to determine the MTF Percent Response as a function of spatial frequency in the film plane. Tables 1 and 2 (below) includes the MTF Percent Response characteristics of the cyan dye images formed by the red light sensitive layers of the described photographic multicolor elements. Higher MTF % Response indicates improved film acutance.

TABLE 1

Multilayer ML-A Results

| | Layer 3 Fast Yellow | Blue | Delta* % B RMS | MTF % Response Red Sensitive Layer Cycles/mm | | | |
|---|---|---|---|---|---|---|---|
| Variation | Emulsion | Speed | Granularity | 5.0 | 10 | 20 | 60 |
| ML-A-1 | E-1 (1.4 μm, 14 mole % I, 3D grains) | 100 | 0 | 100.2 | 95.1 | 70.5 | 15.1 |
| ML-A-2 | E-2 (4.5 × 0.138 μm, 2 mole % I, T-grains) | 91 | −17.8 | 100.4 | 97.5 | 80.3 | 24.3 |
| ML-A-3 | E-2 (4.5 × 0.138 μm, 2 mole % I, T-grains) + FED-2 | 103 | −19.0 | 100.1 | 97.2 | 80.8 | 24.9 |

*Delta % B RMS Granularity measured at a point 1.0 logE above the speed point, taken vs. granularity of ML-A-1 as check.

The results in Table 1 (ML-A) show that, when used as high speed blue emulsions, large tabular AgBrI emulsions are generally inferior to 3D emulsions for photographic sensitivity (speed). However, with the addition of a fragmentable electron donor such as FED-2, these large tabular grains can be brought up to acceptable sensitivity for high speed applications. The combination of the fragmentable electron donor and the large tabular grains gives emulsions that are superior in overall performance to the large 3D emulsions, offering improvements in both RMS granularity of the yellow layer and MTF response of underlying layers.

ML-B-1: Like ML-A Except

Layer 1 (Protective Overcoat Layer): gelatin at 0.871.

Layer 2 (UV Filter Layer): silver bromide Lippman emulsion at 0.215, UV-1 at 0.114 and UV-2 at 0.022 and gelatin at 0.860.

Layer 3 (Fast Yellow Layer): blue sensitized silver iodobromide 3d emulsion (E-1) at 1.72, YC-1 at 0.082, YC-2 at 0.234 and gelatin at 2.0.

Layer 4 (Slow Yellow Layer): a blend of two blue sensitized (all with BSD-1) tabular silver iodobromide emulsions (i) 2.7×0.14 μm, 6.0 mole % I at 0.484, (ii) ) 1.6×0.13 μm, 4.5 mole % I at 0.322, yellow dye forming coupler YC-1 at 0.484, YC-2 at 0.099, IR-1 at 0.036 and gelatin at 1.58.

Layer 5 (Yellow filter layer): YFD-1 at 0.151, YD-1 at 0.043, OxDS-3 at 0.108 and gelatin at 0.646.

Layer 6 (Fast Magenta Layer): a green sensitized (with a mixture of GSD-1 and GSD-2) silver iodobromide tabular emulsions (3.4×0.11 μm, 4.0 mole % iodide) at 1.03, magenta dye forming coupler MC-1 at 0.088, MC-2 at 0.011, MC-3 at 0.003, masking coupler MM-1 at 0.022 and gelatin at 1.25.

Layer 7 (Mid Magenta Layer): a green sensitized (with a mixture of GSD-1 and GSD-2) silver iodobromide tabular emulsion 12×0.14 μm, 4.5 mole % iodide at 1.28, magenta dye forming coupler MC-4 at 0.12, MC-2 at 0.074, MC-3 at 0.022, masking coupler MM-1 at 0.048, IR-2 at 0.010 and gelatin at 1.42.

Layer 8 (Slow magenta layer): a green sensitized (both with a mixture of GSD-1 and GSD-2) silver iodobromide tabular emulsion: 0.7×0.14 μm, 0.3 mole % iodide at 0.484, magenta dye forming coupler MC-4 at 0.099, MC-2 at 0.069, MC-3 at 0.021, masking coupler MM-1 at 0.086 and gelatin at 0.915.

Layer 9 (Interlayer): OxDS-3 at 0.108, YD-1 at 0.065 and gelatin at 1.08.

Layer 10 (Fast Cyan layer): a blend of two red-sensitized sensitized (with a mixture of RSD-1 and RSD-2) emulsions: (i) a large sized iodobromide tabular grain emulsion (3.0×0.12 μm, 4.0 mole % I) at 0.635, (ii) a smaller iodobromide tabular emulsion (1.3×0.0.14 μm), 4.5 mole % I) at 0.334, cyan dye-forming coupler CC-1 at 0.060, yellow dye-forming coupler YC-2 at 0.022, masking coupler CM-1 at 0.027, soluble mercaptide releasing coupler B-2 at 0.044 and gelatin at 1.32.

Layer 11 (Slow cyan layer): a blend of two red sensitized (all with a mixture of RSD-1 and RSD-2) silver emulsions: (i) a large sized iodobromide tabular grain emulsion (1.3×0.14 μm, 4.5 mole % I) at 0.951, (ii) a smaller iodobromide tabular emulsion (1.2×0.0.11 μm), 3.5 mole % I) at 0.675, cyan dye-forming coupler CC-1 at 0.409, yellow dye-forming coupler YC-2 at 0.022, masking coupler CM-1 at 0.011, soluble mercaptide releasing coupler B-2 at 0.0.65, IR-4 at 0.017, IR-5 at 0.026, and gelatin at 2.27.

Support: Cellulose triacetate with a RemJet backing on the side opposing the above light sensitive layers.

Samples of each ML-B element were given a stepped exposure to a light source with an effective color temperature of 3200oK and developed in a Kodak ECN-2 Process which includes development using a p-phenylenediamine type compound. A complete description of the Kodak ECN-2 Process is contained in the Kodak H-24 Manual (Manual for Processing Eastman Motion Picture Films; H-24 Manual; Eastman Kodak Company, Rochester, N.Y.) the description of which is incorporated herein by reference. Granularity and acutance tests were also carried out as as described for ML-A, except that development was in the Kodak ECN-2 Process.

ML-B-2 is like ML-B-1 with the Following Change

Layer 3 (Fast Yellow layer): Emulsion E-3 was used instead of E-1.

ML-B-3 is like ML-B-2 with the Following Change

Layer 3 (Fast Yellow layer): FED-2 was added to Emulsion E-3 as specified in the description of Emulsion E-3.

TABLE 2

Multilayer ML-B Results

| Variation | Layer 3 Fast Yellow Emulsion | Blue Speed | Delta* % B RMS Granularity | MTF % Response Red Sensitive Layer Cycles/mm 5.0 | 10 | 20 | 60 |
|---|---|---|---|---|---|---|---|
| ML-B-1 | E-1 (1.4 μm, 14 mole % I, 3D grains) | 100 | 0 | 85.2 | 70.5 | 46.1 | 10.9 |
| ML-B-2 | E-3 (3.3 × 0.26 μm, 7 mole % I, T-grains) | 87 | −18.6 | 85.6 | 78.8 | 61.4 | 19.7 |
| ML-B-3 | E-3 (3.3 × 0.26 μm, 7 mole % I, T-grains) + FED-2 | 93 | −8.5 | 85.8 | 78.6 | 61.7 | 19.6 |

*Delta % B RMS Granularity measured at point 0.4 logE above the speed point, taken vs. granularity of ML-B-1 as check.

The results in Table 2 (ML-B) also show that, when used as high speed blue emulsions, large tabular AgBrI emulsions are generally inferior to 3D emulsions for photographic sensitivity (speed). However, with the addition of a fragmentable electron donor such as FED-2, these large tabular grains can be brought up to acceptable sensitivity for high speed applications. The combination of the fragmentable electron donor and the large tabular grains gives emulsions that are superior in overall performance to the large 3D emulsions, offering improvements in both RMS granularity of the yellow layer and MTF response of underlying layers.

Chemical Structures

UV-1

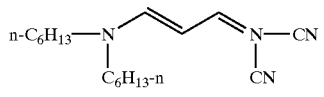

UV-2

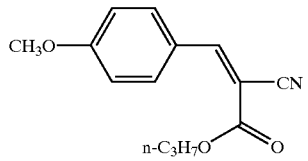

-continued
YFD-1
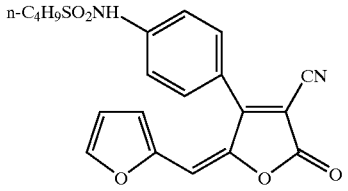
YD-1
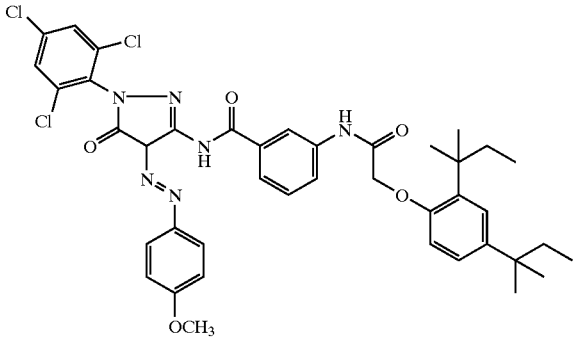
YC-1
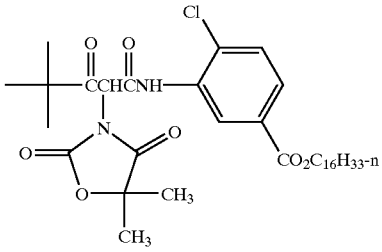
YC-2
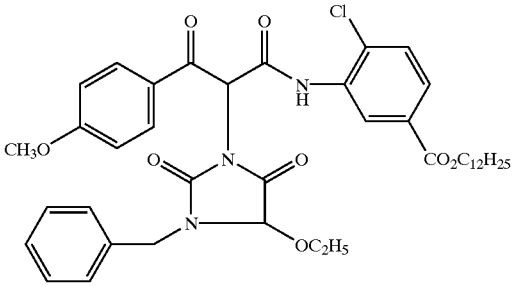
MC-1
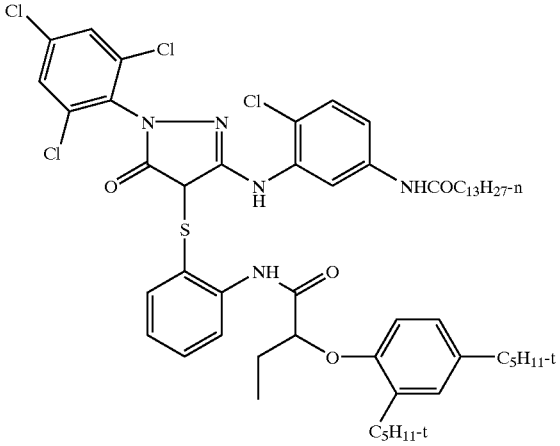
-continued
MC-2
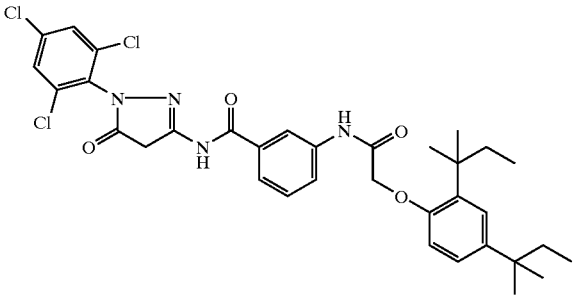
MC-4
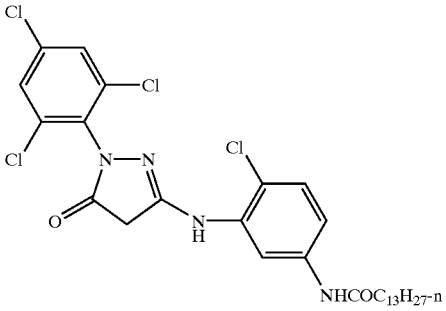
MC-3
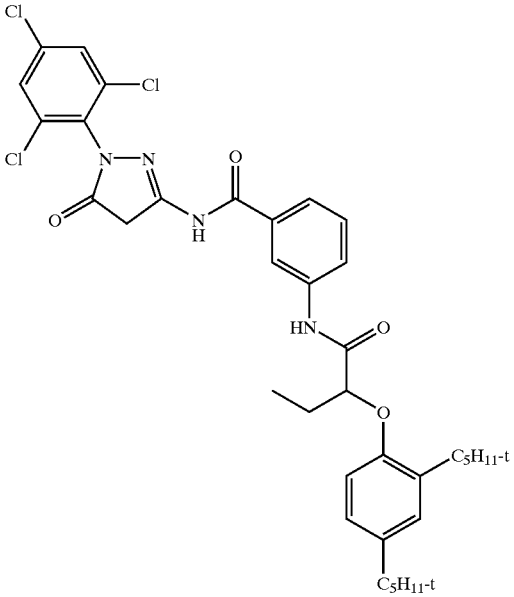
MM-1
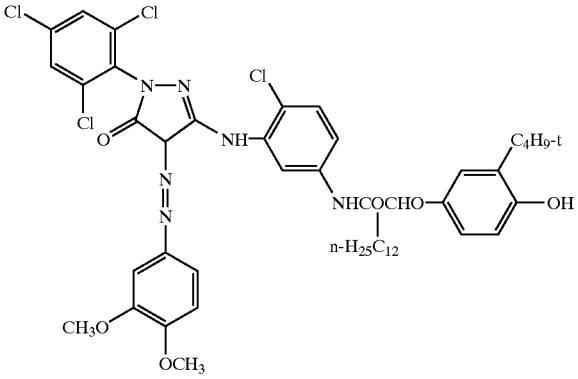

-continued
CM-1
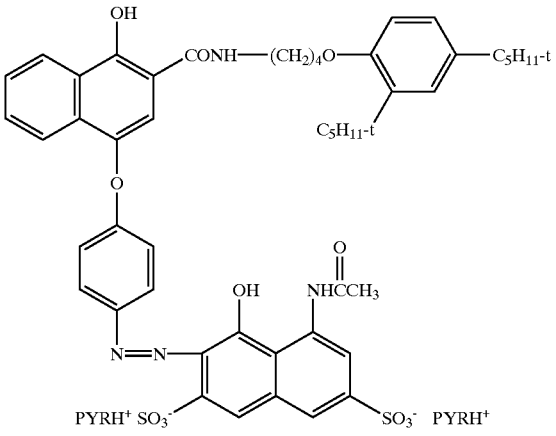
CC-1
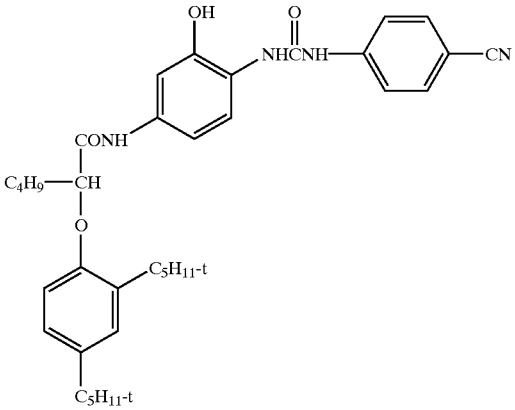
CC-2
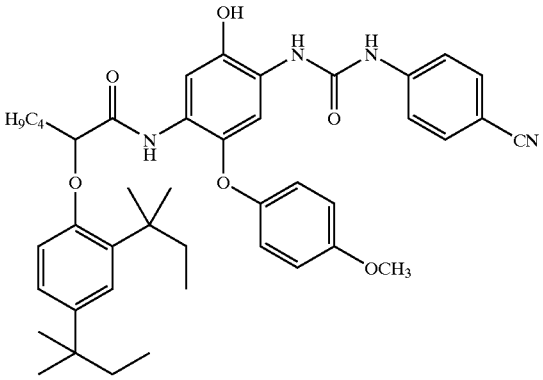
B-1
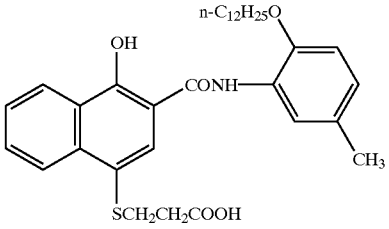
-continued
B-2
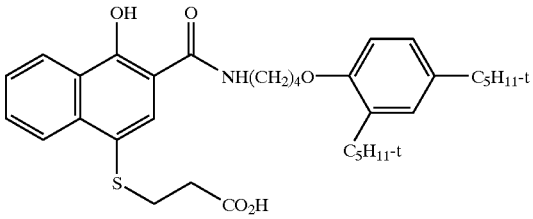
OxDS-1
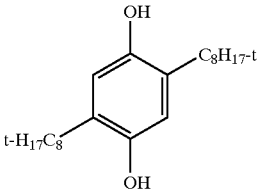
OxDS-2
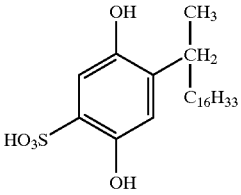
IR-1
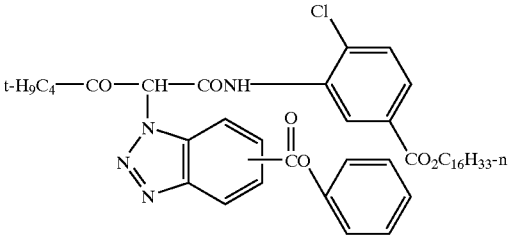
OxDX-3
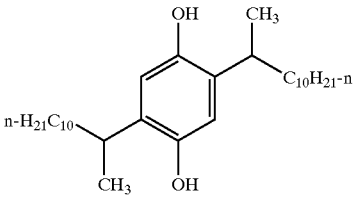
IR-2
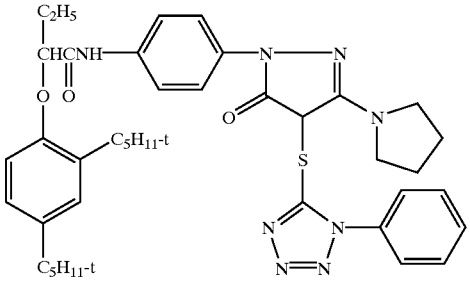

-continued

IR-3

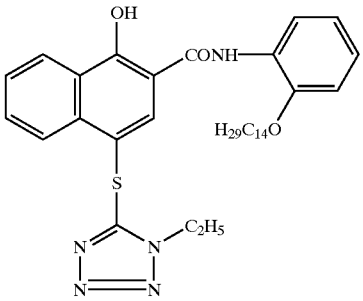

IR-4

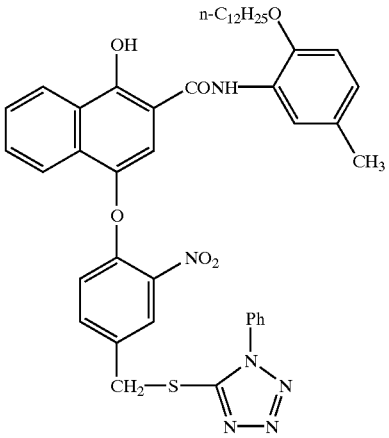

IR-5

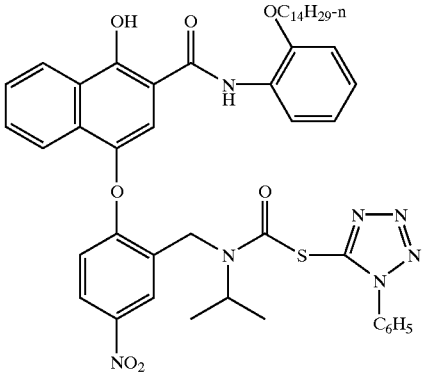

RSD-1

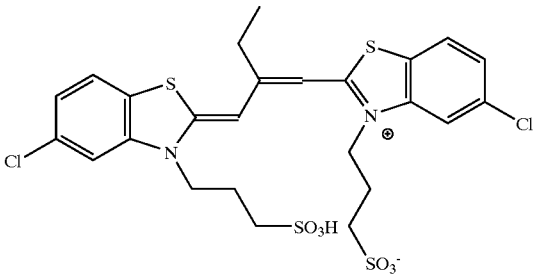

-continued

RSD-2

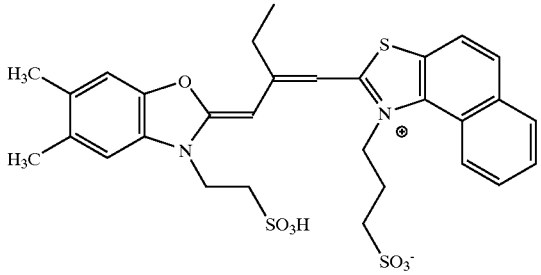

GSD-1

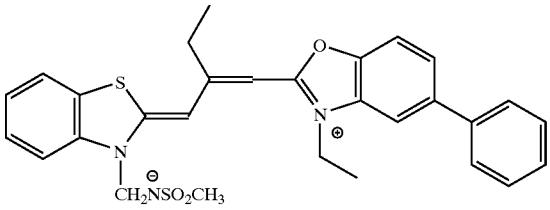

GSD-2

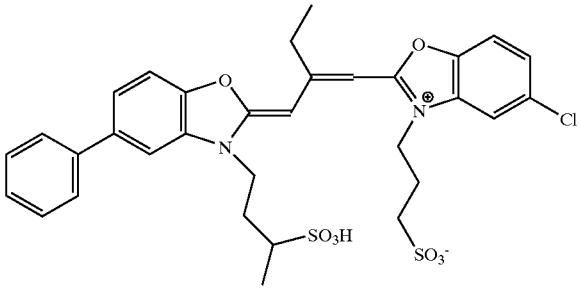

The invention has been described in detail with particular reference to certain preferred embodiments thereof, but it will be understood that variations and modifications can be effected within the spirit and scope of the invention.

What is claimed is:

1. A multicolor negative silver halide photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one blue-sensitive silver halide emulsion layer having associated therewith at least one yellow dye-forming coupler, wherein said blue sensitive silver halide emulsion layer comprises, in combination, large tabular grains having an equivalent circular diameter of greater than 2 $\mu$m and a fragmentable electron donating compound, said combination of large tabular grains and fragmentable electron donating compound providing beneficial lowering of RMS granularity characteristics of said blue sensitive silver halide emulsion layer and improved MTF response in underlying layers, said fragmentable electron donating compound being of the formula $$Q—X—Y'$$

$$A—(X—Y')_k$$

$$(A)_k—X—Y'$$

$$Z—(X—Y')_k$$

or $$(Z)_k—X—Y'$$

wherein:

Z is a light absorbing group;

k is 1 or 2;

A is a silver halide adsorptive group; and

Q represents the atoms necessary to form a chromophore comprising an amidinium-ion, a carboxyl-ion or dipolar-amidic chromophoric system when conjugated with X—Y';

X is an electron donor moiety, Y' is a leaving proton H or a leaving group Y, with the proviso that if Y' is H a base, β, is covalently linked directly or indirectly to X and wherein:

1) X—Y' has an oxidation potential between 0 and about 1.4 V; and 2) the oxidized form of X—Y' fragments to give the radical X. and the leaving fragment Y'; and, optionally, 3) the radical X. has an oxidation potential <0.7V.

2. A photographic element according to claim 1, wherein the tabular grains have an equivalent circular diameter of greater than 3 μm.

3. A photographic element according to claim 1, wherein the tabular grains have an equivalent circular diameter of greater than 4 μm.

4. A photographic element according to claim 1, wherein the layer has been sensitized with a dye of formula VII or with the combination of a dye of formula (VI) and a dye of formula (VII):

(VI)

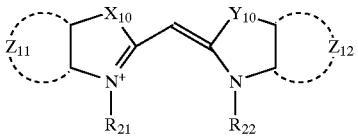

(VII)

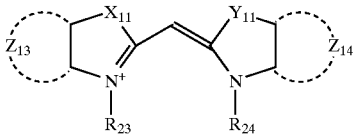

wherein:

$Z_{11}$, $Z_{12}$, $Z_{13}$, and $Z_{14}$ independently represent the atoms necessary to complete a substituted or unsubstituted benzene or naphthylene;

$X_{10}$, $Y_{10}$, $X_{11}$ and $Y_{11}$ are independently O, S, Se or $NR_{25}$, provided that at least $X_{10}$ or $Y_{10}$ is O or $NR_{25}$, wherein $R_{25}$ is an alkyl, alkenyl or aryl, any of which may be substituted or unsubstituted;

$R_{21}$, $R_{22}$, $R_{23}$ and $R_{24}$ independently represent an alkyl, alkenyl or aryl group, any or which may be substituted or unsubstituted;

and wherein the formula (VI) dye on the emulsion has a peak sensitization between 400–445 nm and the formula (VII) dye on the emulsion has a peak sensitization between 446–500 nm.

5. A photographic element according to claim 1, wherein X is of structure (I):

(I)

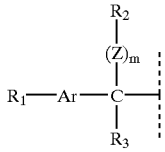

$R_1$ represents R, or a carboxyl, amide, sulfonamide, halogen, $NR_2$, $(OH)_n$, $(OR')_n$, or $(SR)_n$ group;

R'represents an alkyl or substituted alkyl group;

n=1 to 3;

$R_2$ represents R or Ar';

$R_3$ represents R or Ar';

$R_2$ and $R_3$ together can form a 5- to 8-membered ring:

m=0 or 1;

Z represents O, S, Se, or Te;

Ar represents an aryl group;

$R_2$ and Ar can be linked to form a 5- to 8-membered ring;

$R_3$ and Ar can be linked to form a 5- to 8-membered ring;

Ar' represents an aryl group; and

R represents a hydrogen atom or an unsubstituted or substituted alkyl group.

6. A photographic element according to claim 5, wherein the compound of Structure (I) is selected from:

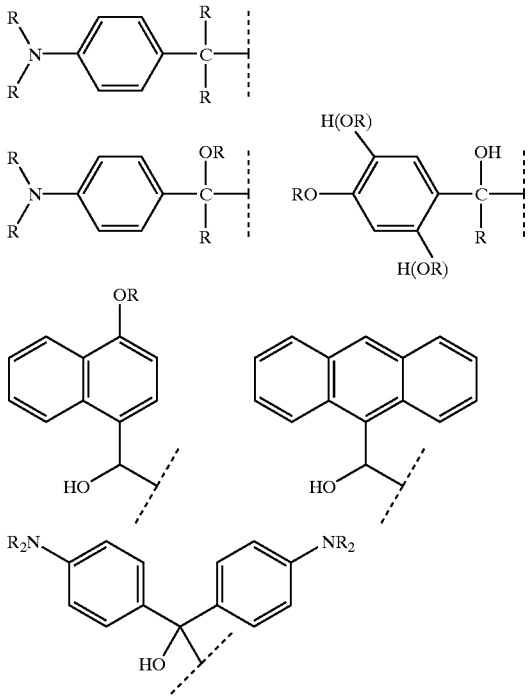

-continued

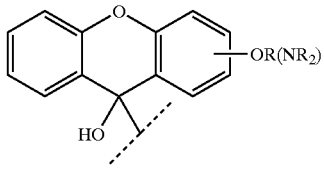

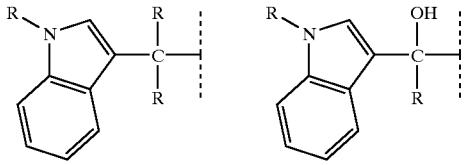

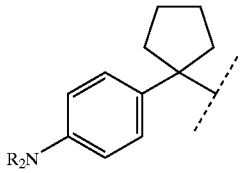

and

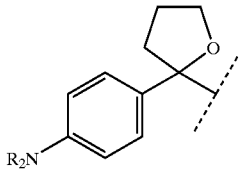

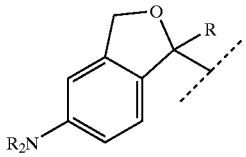

wherein each R is independently a hydrogen atom or a substituted or unsubstituted alkyl group.

7. A photographic element according to claim 1, wherein X is a compound of structure (II):

(II)

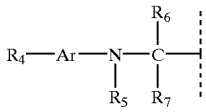

wherein:

Ar represents an aryl group or a heterocyclic group;

$R_4$ represents a substituent having a Hammett sigma value of −1 to +1, $R_5$ represents R or Ar';

$R_6$ and $R_7$ represents R or Ar', or $R_6$ can be linked to Ar to form a 5-to 8-membered ring with Ar, in which case $R_6$ can be a heteroatom;

$R_5$ and Ar can be linked to form a 5- to 8-membered ring;

$R_5$ and $R_6$ can be linked to form a 5- to 8-membered ring;

$R_6$ and $R_7$ can be linked to form a 5- to 8-membered ring;

Ar' represents an aryl group; and

R represents a hydrogen atom or an unsubstituted or substituted alkyl group.

8. A photographic element according to claim 7, wherein X selected from:

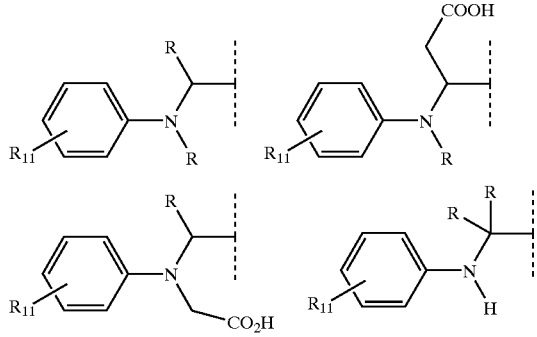

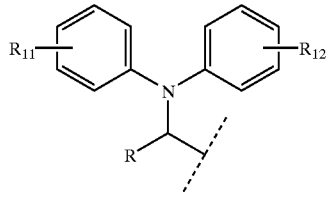

where or $R_{11}$ and $R_{12}$ represent H or an alkyl, alkoxy, alkylthio, halo, carbamoyl, carboxyl, amido, formyl sulfonyl, sulfonamido, or nitrile group;

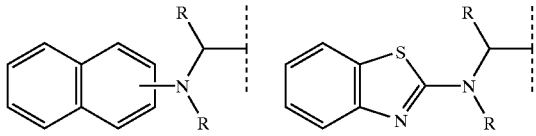

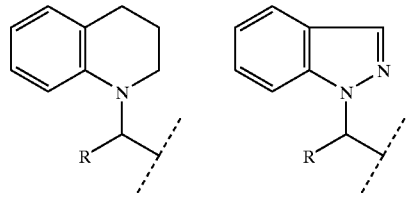

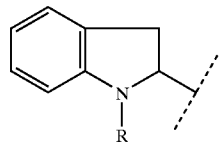

or

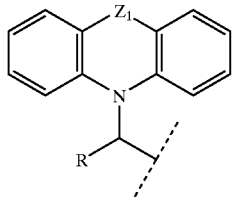

where $Z_1$ represents a covalent bond, S, O, Se, NR, $CR_2$, CR═CR, or $CH_2CH_2$ or

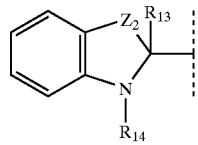

where $Z_2$ represents S, O, Se, NR, $CR_2$, or CR═CR, $R_{13}$, represents an alkyl, substituted alkyl or aryl group, and $R_{14}$ represents H, or an alkyl, substituted alkyl, or aryl group.

9. A photographic element according to claim 1, wherein X is a compound of structure (III):

(III)

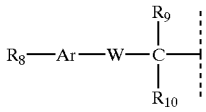

wherein:

W represents O, S, or Se;

Ar represents an aryl group or a heterocyclic group;

$R_8$ represents R, carboxyl, $NR_2$, $(OR)_n$, or $(SR)_n$ (n=1–3);

$R_9$ and $R_{10}$ represent R or Ar';

$R_9$ and Ar can be linked to form a 5- to 8-membered ring;

Ar'represents an aryl group; and

R represents a hydrogen atom or an unsubstituted or substituted alkyl group.

10. A photographic element according to claim 9, wherein X is selected from:

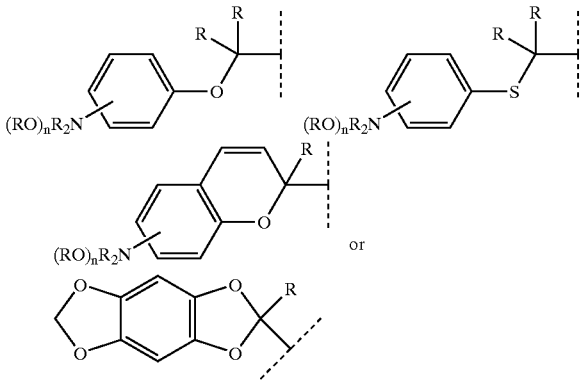

where n=1 to 3.

11. A photographic element according to claim 1, wherein X is of structure (IV):

(IV)

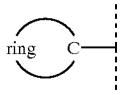

wherein:

"ring" represents a substituted or unsubstituted 5-, 6- or 7-membered unsaturated ring, preferably a heterocyclic ring.

12. A photographic element according to claim 11, wherein X is selected from:

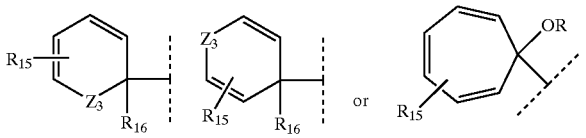

where $Z_3$ represents O, S, Se, or NR;

$R_{15}$ represents R, OR, or $NR_2$; and $R_{16}$ represents an alkyl or substituted alkyl group; and R is a hydrogen atom or an unsubstituted or substituted alkyl group.

13. A photographic element according to claim 1, wherein Y' is selected from (1) through (5):

(1) X', where X' is an X group as defined in structures I–IV and may be the same as or different from the X group to which it is attached (2)

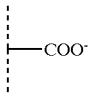

(3)

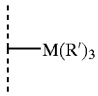

where M represents Si, Sn or Ge; and R' represents an alkyl or substituted alkyl group;

(4)

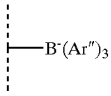

where Ar" represents an aryl or substituted aryl group;

(5)

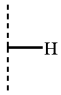

wherein structures I–IV are as follows:

(I)

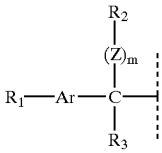

wherein:

$R_1$ represents R, or a carboxyl, amide, sulfonamide, halogen, $NR_2$, $(OH)_n$, $(OR')_n$, or $(SR)_n$ group;

R' represents an alkyl or substituted alkyl group;

n=1 to 3;

$R_2$ represents R or Ar';

$R_3$ represents R or Ar';

$R_2$ and $R_3$ together can form a 5- to 8-membered ring:

m=0 or 1;

Z represents O, S, Se, or Te;

Ar represents an aryl group;

$R_2$ and Ar can be linked to form a 5- to 8-membered ring;

$R_3$ and Ar can be linked to form a 5- to 8-membered ring;

Ar' represents an aryl group; and

R represents a hydrogen atom or an unsubstituted or substituted alkyl group;

(II)

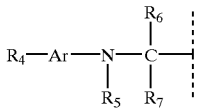

wherein:

Ar represents an aryl group or a heterocyclic group;

$R_4$ represents a substituent having a Hammett sigma value of −1 to +1, $R_5$ represents R or Ar';

$R_6$ and $R_7$ represents R or Ar', or $R_6$ can be linked to Ar to form a 5- to 8-membered ring with Ar, in which case $R_6$ can be a heteroatom;

$R_5$ and Ar can be linked to form a 5- to 8-membered ring;

$R_5$ and $R_6$ can be linked to form a 5- to 8-membered ring;

$R_6$ and $R_7$ can be linked to form a 5- to 8-membered ring;

Ar' represents an aryl group; and

R represents a hydrogen atom or an unsubstituted or substituted alkyl group;

(III)

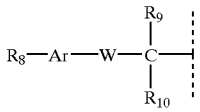

wherein:

W represents O, S, or Se;

Ar represents an aryl group or a heterocyclic group;

$R_8$ represents R, carboxyl, $NR_2$, $(OR)_n$, or $(SR)_n$ (n=1–3);

$R_9$ and $R_{10}$ represent R or Ar';

$R_9$ and Ar can be linked to form a 5- to 8-membered ring;

Ar' represents an aryl group; and

R represents a hydrogen atom or an unsubstituted or substituted alkyl group; and (IV)

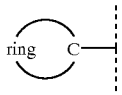

wherein:

"ring" represents a substituted or unsubstituted 5-, 6- or 7-membered unsaturated ring.

14. A photographic element according to claim 1, wherein the fragmentable electron donor compound is of the formula:

$$Z—(X—Y')_k$$

or $$(Z)_k—X—Y'$$

wherein Z is derived from a cyanine dye, complex cyanine dye, merocyanine dye, complex merocyanine dye, homopolar cyanine dye, styryl dye, oxonol dye, hemioxonol dye, or hemicyanine dye.

15. A photographic element according to claim 1, wherein the fragmentable electron donor compound is of the formula:

$$A—(X—Y')_k$$

or $$(A)_k—X—Y'$$

wherein: A is a silver-ion ligand moiety or a cationic surfactant moiety.

16. A photographic element according to claim 15, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

17. A photographic element according to claim 1, wherein the fragmentable electron donor compound is of the formula:

$$Q—X—Y'$$

wherein Q represents a chromophoric system comprisisng a cyanine, complex cyanine, hemicyanine, merocyanine, or complex merocyanine dye.

18. A photographic element according to claim 1, wherein the fragmentable electron donor compound is an ionic compound selected from the group consisting of:

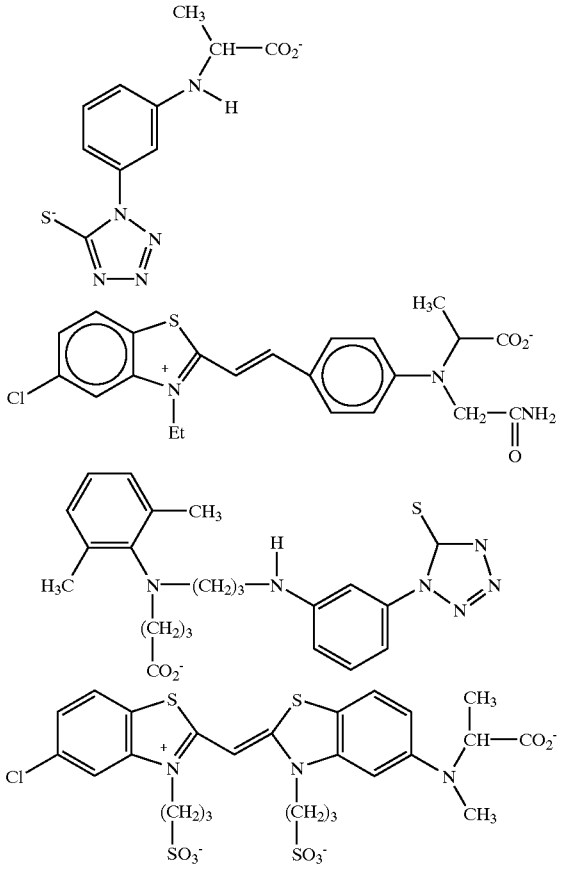

-continued

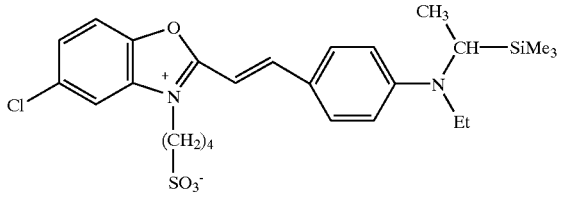

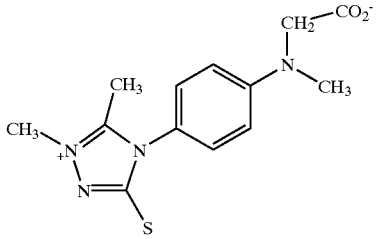

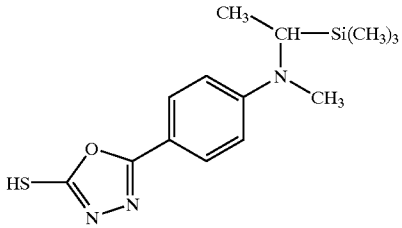

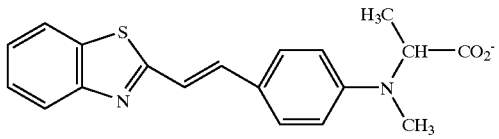

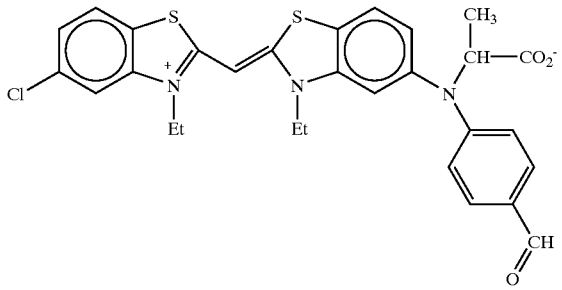

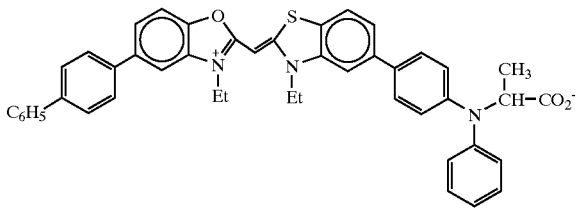

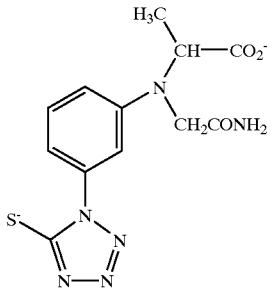

and

-continued

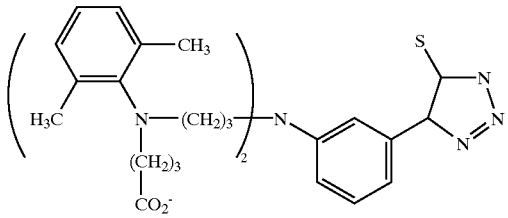

19. A photographic element according to claim 18, wherein the fragmentable electron donor compound is an ionic compound the formula:

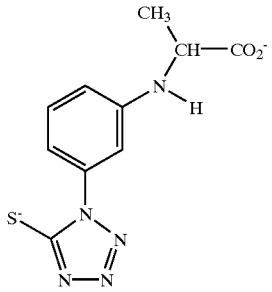

20. A single use camera comprising a roll of film, a taking lens, a shutter release, a film advance and a viewfinder, wherein the roll of film comprises a transparent support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein said blue sensitive silver halide emulsion layer comprises large silver iodobromide tabular grains having an average equivalent circular diameter of greater than 2 $\mu$m and contains a fragmentable electron donor compound of the formula $$Q—X—Y'$$

$$A—(X—Y')_k$$

$$(A)_k—X—Y'$$

$$Z—(X—Y')_k$$

or $$(Z)_k—X—Y'$$

wherein:

Z is a light absorbing group;

kis 1 or2;

A is a silver halide adsorptive group; and

Q represents the atoms necessary to form a chromophore comprising an amidinium-ion, a carboxyl-ion or dipolar-amidic chromophoric system when conjugated with X—Y';

X is an electron donor moiety, Y' is a leaving proton H or a leaving group Y, with the proviso that if Y' is H a base, β, is covalently linked directly or indirectly to X and wherein:

1) X—Y' has an oxidation potential between 0 and about 1.4 V; and
2) the oxidized form of X—Y' fragments to give the radical X. and the leaving fragment Y'; and, optionally,
3) the radical X. has an oxidation potential <0.7V.

21. A single use camera in accordance with claim 20, further comprising a flash unit.

22. A multicolor negative silver halide photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein said blue sensitive silver halide emulsion layer comprises, in combination, large tabular grains having an equivalent circular diameter of greater than 2 μm and a fragmentable electron donating compound, said combination of large tabular grains and said fragmentable electron donating compound providing beneficial lowering of RMS granularity characteristics of said blue sensitive silver halide emulsion layer and improved MTF response in underlying layers, said fragmentable electron donating compound being of the formula X—H or an electron donor which contains an —X—H moiety;

wherein

X is an electron donor moiety to which a base $\beta^-$ is directly or indirectly covalently linked, H is a hydrogen atom and wherein:

1) X—H has an oxidation potential between 0 and about 1.4 V; and
2) the oxidized form of X—H fragments to give the radical X. and the leaving proton $H^+$; and, optionally,
3) the radical X. has an oxidation potential <0.7V.

23. A photographic element according to claim 22, wherein the tabular grains have an equivalent circular diameter of greater than 3 μm.

24. A photographic element according to claim 22, wherein the tabular grains have an equivalent circular diameter of greater than 4 μm.

25. A photographic element according to claim 22, wherein the layer has been sensitized with a dye of formula VII or with the combination of a dye of formula (VI) and a dye of formula (VII):

(VI)

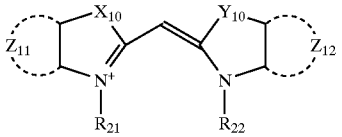

(VII)

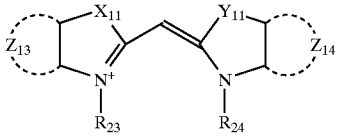

wherein:

$Z_{11}$, $Z_{12}$, $Z_{13}$, and $Z_{14}$ independently represent the atoms necessary to complete a substituted or unsubstituted benzene or naphthylene;

$X_{10}$, $Y_{10}$, $X_{11}$ and $Y_{11}$ are independently O, S, Se or $NR_{25}$, provided that at least $X_{10}$ or $Y_{10}$ is O or $NR_{25}$, wherein $R_{25}$ is an alkyl, alkenyl or aryl, any of which may be substituted or unsubstituted;

$R_{21}$, $R_{22}$, $R_{23}$ and $R_{24}$ independently represent an alkyl, alkenyl or aryl group, any or which may be substituted or unsubstituted; and wherein the formula (VI) dye on the emulsion has a peak sensitization between 400–445 nm and the formula (VII) dye on the emulsion has a peak sensitization between 446–500 nm.

26. A photographic element according to claim 22, wherein X is of structure (I):

(I)

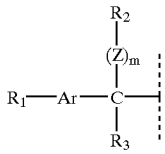

$R_1$ represents R, or a carboxyl, amide, sulfonamide, halogen, $NR_2$, $(OH)_n$, $(OR')_n$, or $(SR)_n$ group;

R' represents an alkyl or substituted alkyl group;

n=1 to 3;

$R_2$ represents R or Ar';

$R_3$ represents R or Ar';

$R_2$ and $R_3$ together can form a 5- to 8-membered ring;

m=0 or 1;

Z represents O, S, Se, or Te;

Ar represents an aryl group $R_2$ and Ar can be linked to form a 5- to 8-membered ring;

$R_3$ and Ar can be linked to form a 5- to 8-membered ring;

Ar' represents an aryl group; and

R represents a hydrogen atom or an unsubstituted or substituted alkyl group.

27. A photographic element according to claim 26, wherein the compound of Structure (I) is selected from:

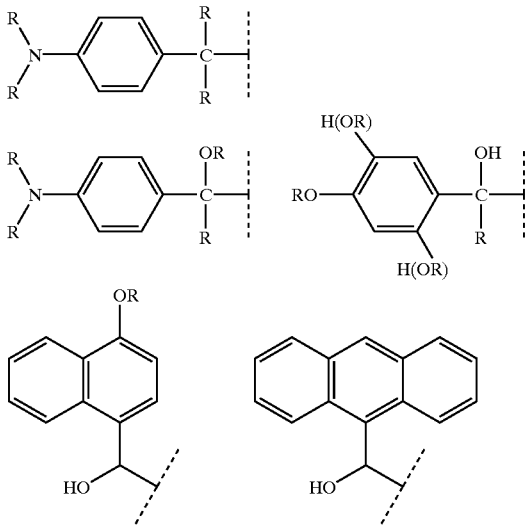

-continued

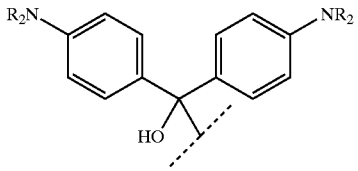

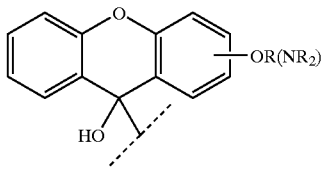

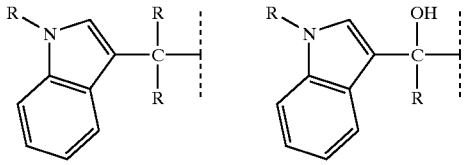

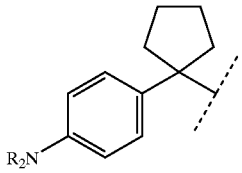

and

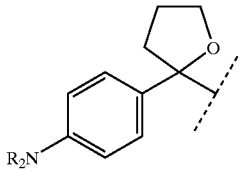

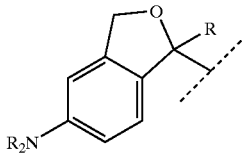

wherein each R is independently a hydrogen atom or a substituted or unsubstituted alkyl group.

28. A photographic element according to claim 22, wherein X is a compound of structure (II):

(II)

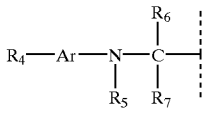

wherein:

Ar represents an aryl group or a heterocyclic group $R_4$ represents a substituent having a Hammett sigma value of −1 to +1, $R_5$ represents R or Ar;'

$R_6$ and $R_7$ represents R or Ar', or $R_6$ can be linked to Ar to form a 5- to 8-membered ring with Ar, in which case $R_6$ can be a heteroatom;

$R_5$ and Ar=can be linked to form a 5- to 8-membered ring;

$R_5$ and $R_6$ can be linked to form a 5- to 8-membered ring;

$R_6$ and $R_7$ can be linked to form a 5- to 8-membered ring;

Ar' represents an aryl group; and

R represents a hydrogen atom or an unsubstituted or substituted alkyl group.

29. A photographic element according to claim 28, wherein X selected from:

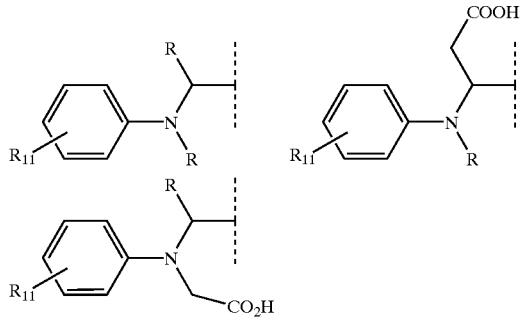

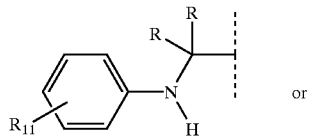

or

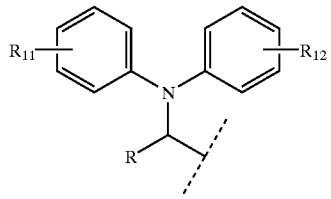

where $R_{11}$ and $R_{12}$ represent H or an alkyl, alkoxy, alkylthio, halo, carbamoyl, carboxyl, amido; formyl sulfonyl, sulfonamido, or nitrile group;

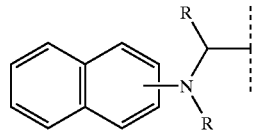

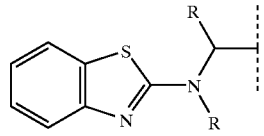

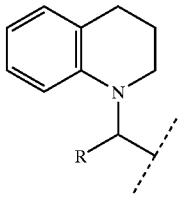

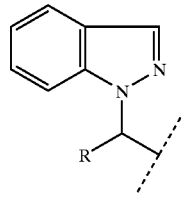

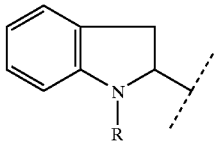

or

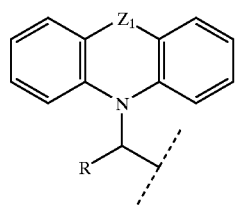

where $Z_1$ represents a covalent bond, S, O, Se, NR, $CR_2$, CR═CR, or $CH_2CH_2$ or

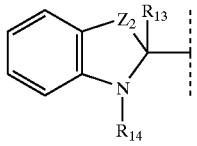

where $Z_2$ represents S, O, Se, NR, $CR_2$, or CR=CR, $R_{13}$, represents an alkyl, substituted alkyl or aryl group, and $R_{14}$ represents H, or an alkyl, substituted alkyl, or aryl group.

30. A photographic element according to claim 22, wherein X is a compound of structure (III):

(III)

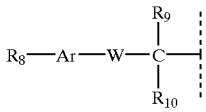

wherein:

W represents O, S, or Se;

Ar represents an aryl group or a heterocyclic group;

$R_8$ represents R, carboxyl, $NR_2$, $(OR)_n$, or $(SR)_n$ (n=1–3);

$R_9$ and $R_{10}$ represent R or Ar';

$R_9$ and Ar can be linked to form a 5- to 8-membered ring;

Ar' represents an aryl group; and

R represents a hydrogen atom or an unsubstituted or substituted alkyl group.

31. A photographic element according to claim 30, wherein X is selected from:

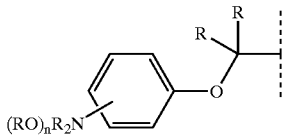

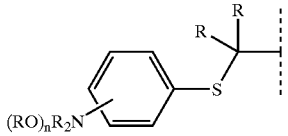

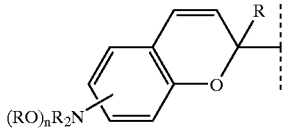

or

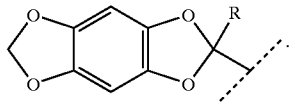

where n=1 to 3.

32. A photographic element according to claim 22, wherein X of structure (IV):

(IV)

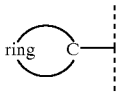

wherein:

"ring" represents a substituted or unsubstituted 5-, 6- or 7-membered unsaturated ring, preferably a heterocyclic ring.

33. A photographic element according to claim 32, wherein X is selected from:

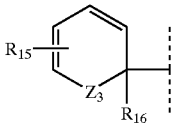

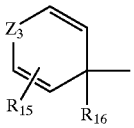

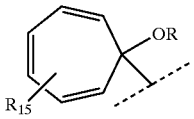

where $Z_3$ represents O, S, Se, or NR $R_{15}$ represents R, OR, $NR_2$;

$R_{16}$ represents an alkyl or substituted alkyl group; and

R is a hydrogen atom or an unsubstituted or substituted alkyl group.

34. A single use camera comprising a roll of film, a taking lens, a shutter release, a film advance and a viewfinder, wherein the roll of film comprises a transparent support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, wherein said blue sensitive silver halide emulsion layer comprises large silver iodobromide tabular grains having an average equivalent circular diameter of greater than 2 $\mu$m and contains a fragmentable electron donor compound of the formula X—H or an electron donor which contains an —X—H moiety; wherein X is an electron donor moiety to which a base $\beta^-$ is directly or indirectly covalently linked, H is a hydrogen atom and wherein:

1) X—H has an oxidation potential between 0 and about 1.4 V; and 2) the oxidized form of X—H fragments to give the radical X. and the leaving proton $H^+$; and, optionally, 3) the radical X. has an oxidation potential $\leqq$0.7V.

* * * * *